US006183922B1

(12) United States Patent
Takai et al.

(10) Patent No.: US 6,183,922 B1
(45) Date of Patent: Feb. 6, 2001

(54) ELECTROPHOTOGRAPHIC PHOTOSENSITIVE MEMBER, PROCESS CARTRIDGE, AND ELECTROPHOTOGRAPHIC APPARATUS

(75) Inventors: Hideyuki Takai, Yokohama; Masato Tanaka, Shizuoka-ken; Kan Tanabe, Susono, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/363,856

(22) Filed: Jul. 30, 1999

(30) Foreign Application Priority Data

Jul. 31, 1998 (JP) ..... 10-217773
Jul. 31, 1998 (JP) ..... 10-217778

(51) Int. Cl.[7] ..... G03G 15/06
(52) U.S. Cl. ..... 430/72; 430/75; 430/78
(58) Field of Search ..... 430/72, 75, 78; 399/159

(56) References Cited

U.S. PATENT DOCUMENTS

| | | | | |
|---|---|---|---|---|
| 4,810,607 | | 3/1989 | Matsumoto et al. | 430/73 |
| 4,895,781 | | 1/1990 | Takai | 430/58 |
| 4,942,106 | | 7/1990 | Takai et al. | 430/58 |
| 4,988,593 | | 1/1991 | Takai | 430/58 |
| 4,994,338 | | 2/1991 | Takai | 430/76 |
| 5,034,294 | | 7/1991 | Go et al. | 430/58 |
| 5,403,691 | * | 4/1995 | Oshiba et al. | 430/72 |
| 5,411,828 | * | 5/1995 | Kashizaki | 430/72 |
| 5,459,247 | * | 10/1995 | Hashimoto | 430/72 |
| 5,543,257 | | 8/1996 | Suzuki et al. | 430/58 |
| 5,569,749 | * | 10/1996 | Kouno et al. | 430/72 |
| 5,576,131 | | 11/1996 | Takai et al. | 430/59 |
| 5,622,799 | | 4/1997 | Suzuki et al. | 430/58 |
| 5,629,116 | | 5/1997 | Rashizaki et al. | 430/58 |
| 5,749,029 | | 5/1998 | Umeda | 399/128 |

FOREIGN PATENT DOCUMENTS

| | | |
|---|---|---|
| 0435165 | 7/1991 | (EP) . |
| 0632014 | 1/1995 | (EP) . |
| 0648737 | 4/1995 | (EP) . |
| 0757035 | 2/1997 | (EP) . |
| 0823668 | 2/1998 | (EP) . |
| 313033 | 11/1993 | (JP) . |
| 334272 | 12/1994 | (JP) . |
| 321409 | 12/1995 | (JP) . |
| 335975 | 12/1995 | (JP) . |
| 088441 | 4/1996 | (JP) . |
| 189930 | 7/1997 | (JP) . |
| 240051 | 9/1997 | (JP) . |
| 275242 | 10/1997 | (JP) . |

OTHER PUBLICATIONS

Patent Abstracts and Japan, vol. 1998, No. 1 (Jan. 1998) for JP 09–240051.

* cited by examiner

*Primary Examiner*—John Goodrow
(74) *Attorney, Agent, or Firm*—Fitzpatrick, Cella, Harper & Scinto

(57) ABSTRACT

An electrophotographic photosensitive member is disclosed which is comprised of a support and a photosensitive layer provided thereon and is exposed to semiconductor laser light having a wavelength of from 380 nm to 500 nm. The photosensitive layer contains an azo pigment represented by the general formula: $Ar—(—N{=}N—Cp)_n$.

45 Claims, 2 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

This invention relates to an electrophotographic photosensitive member, a process cartridge and an electrophotographic apparatus, and more particularly to an electrophotographic photosensitive member, a process cartridge and an electrophotographic apparatus which are suited for short-wavelength semiconductor lasers capable of making images have higher resolution.

2. Related Background Art

In electrophotographic apparatus making use of lasers as light sources as typified by laser printers, semiconductor lasers having oscillation wavelength around 800 nm or around 680 nm are prevailingly used. In recent years, various approaches to higher resolution are made with an increase in demand for reproducing images having a higher image quality. Wavelengths of lasers also deeply concern the higher resolution. As disclosed in Japanese Patent Application Laid-Open No. 9-240051, the shorter oscillation wavelength a laser has, the smaller spot diameter the laser can have. This enables formation of latent images having a high resolution.

Some methods are available for making laser oscillation wavelength shorter.

One of the methods is a method in which a non-linear optical material is utilized so that the wavelength of laser light is shortened to half by using secondary higher harmonic generation (SHG) (e.g., Japanese Patent Applications Laid-Open No. 9-275242, No. 9-189930 and No. 5-313033). This system can achieve a long life and a large output, since it can use GaAs semiconductor lasers or YAG lasers as primary light sources, which have already established their technique and can achieve a high output.

Another is a method in which a wide-gap semiconductor is used, and can make apparatus smaller in size than devices utilizing the SHG. ZnSe semiconductor lasers (e.g., Japanese Patent Applications Laid-Open No. 7-321409 and No. 6-334272) and GaN semiconductor lasers (e.g., Japanese Patent Applications Laid-Open No. 8-088441 and No. 7-335975) have long been studied in great deal because of their high emission efficiency.

It, however, has been difficult for these semiconductor lasers to be optimized in their device structure, crystal growth conditions and electrodes, and, because of defects in crystals, has been difficult to make long-time oscillation at room temperature, which is essential for putting them into practical use.

However, with progress of technological innovations on substrates and so forth, Nichia Kagaku Kogyo K.K. reported, in October, 1997, GaN semiconductor laser's continuous oscillation for 1,150 hours (condition: 50° C.), and materialization for its practical use stands close at hand.

Japanese Patent Application Laid-Open No. 9-240051 discloses as a photosensitive member suited for 400 to 500 nm lasers a multi-layer photosensitive member in which a single layer or charge generation layer making use of α-type titanyl phthalocyanine is formed as the outermost layer. Studies made by the present inventors, however, have revealed that the use of such a material brings about such a problem that, because of a poor sensitivity and a very great memory especially for light of about 400 nm, photosensitive members may undergo great potential variations when used repeatedly.

SUMMARY OF THE INVENTION

An object of the present invention is to provide an electrophotographic photosensitive member having high sensitivity characteristics even in a wavelength region of 380 to 500 nm and also having small photomemory and undergoing small potential variations when used repeatedly, and a process cartridge having such a photosensitive member, and also provides an electrophotographic apparatus that is practical and can stably reproduce images with a high image quality by using such a photosensitive member and a short wavelength laser.

The present invention provides an electrophotographic photosensitive member comprising a support and a photosensitive layer provided thereon, and being exposed to semiconductor laser light having a wavelength of from 380 nm to 500 nm;

the photosensitive layer containing an azo pigment represented by the following Formula (1).

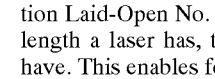

$$Ar\text{-}(N{=}N{-}Cp)_n \quad (1)$$

wherein Ar represents a substituted or unsubstituted aromatic hydrocarbon cyclic group or heterocyclic group which may be bonded directly or via a linking group; Cp represents a coupler residual group represented by the following Formula (2), (3), (4) or (5); and n represents an integer of 1 to 3; provided that a plurality of —N═N—Cp moieties are not bonded to the same benzene ring.

(2)

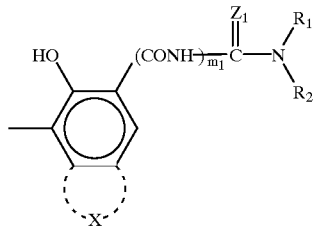

wherein X represents a residual group necessary for condensing with the benzene ring to form a polycyclic aromatic ring or heterocyclic ring; $R_1$ and $R_2$ each represent a hydrogen atom, a substituted or unsubstituted alkyl group, a substituted or unsubstituted aryl group or a substituted or unsubstituted heterocyclic group, and $R_1$ and $R_2$ may form a cyclic amino group via the nitrogen atom in the formula; $Z_1$ represents an oxygen atom or a sulfur atom; and $m_1$ represents an integer of 0 or 1.

(3)

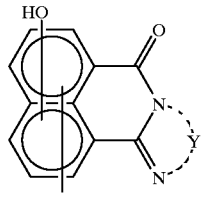

wherein Y represents a substituted or unsubstituted divalent aromatic hydrocarbon cyclic group or a substituted or unsubstituted divalent nitrogen-containing heterocyclic group.

(4)

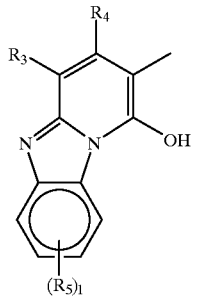

wherein $R_3$ represents a hydrogen atom, a halogen atom, a cyano group, a carboxyl group, an alkoxycarbonyl group, a carbamoyl group or a nitro group; $R_4$ represents a substituted or unsubstituted alkyl group or a substituted or unsubstituted aryl group; $R_5$ represents a halogen atom, a substituted or unsubstituted alkyl group, a substituted or unsubstituted alkoxyl group, a cyano group or a nitro group; and l represents an integer of 0 to 2, and, when l is 2, $R_5$'s may be different groups.

(5)

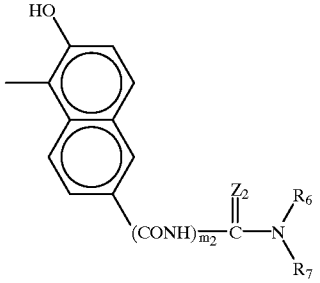

wherein $R_6$ and $R_7$ each represent a hydrogen atom, a substituted or unsubstituted alkyl group, a substituted or unsubstituted aryl group or a substituted or unsubstituted heterocyclic group, and $R_6$ and $R_7$ may form a cyclic amino group via the nitrogen atom in the formula; $Z_2$ represents an oxygen atom or a sulfur atom; and $m_2$ represents an integer of 0 or 1.

The present invention also provides a process cartridge having the electrophotographic photosensitive member described above.

The present invention still also provides an electrophotographic apparatus comprising the electrophotographic photosensitive member described above and a short-wavelength semiconductor laser as an exposure light source.

DESCRIPTION OF THE PREFERRED EMBODIMENTS

Figure 1:
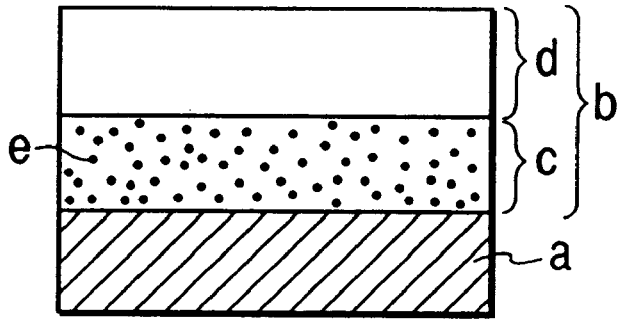
FIG. 1 is a cross-sectional view showing an example of layer configuration of the electrophotographic photosensitive member of the present invention.

The electrophotographic photosensitive member of the present invention is exposed to semiconductor laser light having a wavelength of from 380 nm to 500 nm and has a photosensitive layer containing an azo pigment represented by the following Formula (1).

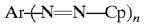

$$Ar\text{-}(N{=}N\text{—}Cp)_n \quad (1)$$

wherein Ar represents a substituted or unsubstituted aromatic hydrocarbon cyclic group or heterocyclic group which may be bonded directly or via a linking group; Cp represents a coupler residual group represented by the following Formula (2), (3), (4) or (5); and n represents an integer of 1 to 3; provided that a plurality of —N═N—Cp moieties are not bonded to the same benzene ring.

(2)

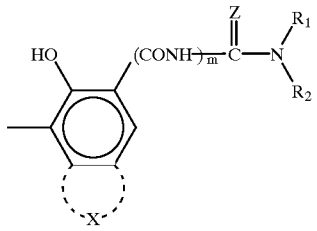

wherein X represents a residual group necessary for condensing with the benzene ring to form a polycyclic aromatic ring or heterocyclic ring; $R_1$ and $R_2$ each represent a hydrogen atom, a substituted or unsubstituted alkyl group, a substituted or unsubstituted aryl group or a substituted or unsubstituted heterocyclic group, and $R_1$ and $R_2$ may form a cyclic amino group via the nitrogen atom in the formula; $Z_1$ represents an oxygen atom or a sulfur atom; and $m_1$ represents an integer of 0 or 1.

(3)

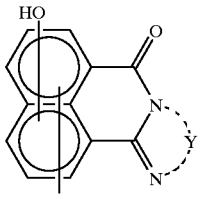

wherein Y represents a substituted or unsubstituted divalent aromatic hydrocarbon cyclic group or a substituted or unsubstituted divalent nitrogen-containing heterocyclic group.

(4)

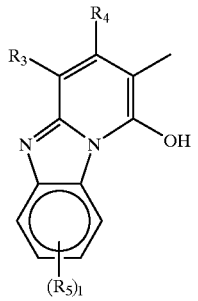

wherein $R_3$ represents a hydrogen atom, a halogen atom, a cyano group, a carboxyl group, an alkoxycarbonyl group, a carbamoyl group or a nitro group; $R_4$ represents a substituted or unsubstituted alkyl group or a substituted or unsubstituted aryl group; $R_5$ represents a halogen atom, a substituted or unsubstituted alkyl group, a substituted or unsubstituted alkoxyl group, a cyano group or a nitro group; and l represents an integer of 0 to 2, and, when l is 2, $R_5$'s may be different groups.

(5)

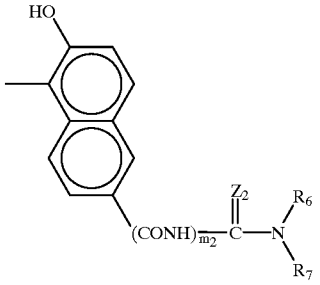

wherein $R_6$ and $R_7$ each represent a hydrogen atom, a substituted or unsubstituted alkyl group, a substituted or unsubstituted aryl group or a substituted or unsubstituted heterocyclic group, and $R_6$ and $R_7$ may form a cyclic amino group via the nitrogen atom in the formula; $Z_2$ represents an oxygen atom or a sulfur atom; and $m_2$ represents an integer of 0 or 1.

The group represented by Ar in Formula (1) may include aromatic hydrocarbon rings such as benzene, naphthalene, fluorene, phenanthrene, anthracene and pyrene, heterocyclic rings such as furan, thiophene, pyridine, indole, benzothiazole, carbazole, acridone, dibenzothiophene, benzoxazole, oxadiazole and thiazole, and those obtained by combining any of the above aromatic hydrocarbon rings or heterocyclic rings directly or with an aromatic group or non-aromatic group, as exemplified by groups such as biphenyl, binaphthyl, diphenylamine, triphenylamine, N-methyldiphenylamine, fluorenone, phenanthrenequinone, anthraquinone, benzanthrone, terphenyl, diphenyloxadiazole, stilbene, distyrylbenzene, azobenzene, azoxybenzene, phenylbenzoxazole, diphenylmethane, diphenylsulfone, diphenyl ether, benzophenone, tetraphenyl-p-phenylenediamine, tetraphenylbenzidine, N-phenyl-2-pyridylamine and N-diphenyl-2-pyridylamine.

The substituent these groups may have may include alkyl groups such as methyl, ethyl, propyl and butyl, alkoxyl groups such as methoxyl, ethoxyl and propoxyl, halogen atoms such as a fluorine atom, a chlorine atom and a bromine atom, dialkylamino groups such as dimethylamino and diethylamino, a hydroxyl group, a nitro group, a cyano group, and halomethyl groups.

The alkyl group represented by $R_1$ and $R_2$ in Formula (2) may include group s such as methyl, ethyl and propyl; the aryl group, groups such as phenyl, naphthyl and anthryl; the heterocyclic group, groups such as pyridyl, thienyl, carbazolyl, benzimidazolyl and benzothiazolyl; and the cyclic amino group containing a nitrogen atom in the ring, pyrrole, pyrroline, pyrrolidine, pyrrolidone, indole, indoline, carbazole, imidazole, pyrazole, pyrazoline, oxazine and phenoxazine.

The substituent these groups may have may include alkyl groups such as methyl, ethyl and propyl, alkoxyl groups such as methoxyl, ethoxyl and propoxyl, halogen atoms such as a fluorine atom, a chlorine atom, a bromine atom and an iodine atom, dialkylamino groups such as dimethylamino and diethylamino, a phenylcarbamoyl group, a nitro group, a cyano group, and halomethyl groups such as a trifluoromethyl group.

In particular, it is preferred in view of sensitivity that any one of $R_1$ and $R_2$ is a hydrogen atom and the other is a phenyl group which may have a substituent, and also the substituent of the phenyl group may preferably be an alkyl group, a halogen atom or a phenylcarbamoyl group. The phenyl group of this phenylcarbamoyl group may further have the substituent described above.

The divalent aromatic hydrocarbon cyclic group and nitrogen-containing heterocyclic group represented by Y in Formula (3) may include divalent groups such as o-phenylene, o-naphthylene, perinapthylene, 1,2-anthrylene, 3,4-pyrazol-di-yl, 2,3-pyridin-di-yl, 4,5-pyridin-di-yl, 6,7-imidazol-di-yl and 6,7-quinolin-di-yl.

The substituent the Y may have may include alkyl groups such as methyl, ethyl, propyl and butyl, alkoxyl groups such as methoxyl, ethoxyl and propoxyl, halogen atoms such as a fluorine atom, a chlorine atom and a bromine atom, dialkylamino groups such as dimethylamino and diethylamino, a hydroxyl group, a nitro group, a cyano group, and halomethyl groups.

The halogen atom represented by $R_3$, $R_4$ and $R_5$ in Formula (4) may include chlorine and bromine; the alkoxycarbonyl group, a methoxycarbonyl group and an ethoxycarbonyl group; the carbamoyl group, a carbamoyl group and a phenylcarbamoyl group; the alkyl group, a methyl group, an ethyl group and a propyl group; the alkoxyl group, a methoxyl group and an ethoxyl group; the aryl group, a phenyl group, a naphthyl group and an anthryl group.

The substituent these group may have may include alkyl groups such as methyl, ethyl, propyl and butyl, alkoxyl groups such as methoxyl, ethoxyl and propoxyl, halogen atoms such as a fluorine atom, a chlorine atom and a bromine atom, dialkylamino groups such as dimethylamino and diethylamino, a hydroxyl group, a nitro group, a cyano group, and halomethyl groups.

The alkyl groups represented by $R_6$ and $R_7$ in Formula (5) may include groups such as methyl, ethyl and propyl; the aryl group, groups such as phenyl, naphthyl and anthryl; the heterocyclic group, groups such as pyridyl, thienyl, carbazolyl, benzimidazolyl and benzothiazolyl; and the cyclic amino group containing a nitrogen atom in the ring, pyrrole, pyrroline, pyrrolidine, pyrrolidone, indole, indoline, carbazole, imidazole, pyrazole, pyrazoline, oxazine and phenoxazine.

The substituent these groups may have may include alkyl groups such as methyl, ethyl, propyl and butyl, alkoxyl groups such as methoxyl, ethoxyl and propoxyl, halogen atoms such as a fluorine atom, a chlorine and a bromine atom, dialkylamino groups such as dimethylamino and diethylamino, a hydroxyl group, a nitro group, a cyano group, and halomethyl groups.

In particular, it is preferred in view of sensitivity that any one of $R_6$ and $R_7$ is a hydrogen atom and the other is a phenyl group which may have a substituent, and also the substituent of the phenyl group may preferably be an alkyl group, a halogen atom or a phenylcarbamoyl group. The phenyl group of this phenylcarbamoyl group may further have the substituent described above.

Preferable examples of the azo pigment which are usable in the present invention are listed below. In the following, the structures are depicted as only the moieties corresponding to Ar and Cp. When n is 2 or 3 and Cp's are different from each other, the structures are shown as Cp1, Cp2 and Cp3.

TABLE 1

| | Ar—N=N—Cp (n = 1) | |
|---|---|---|
| * | Ar | Cp |
| 2-1 | 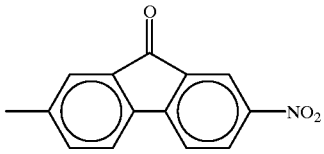 | 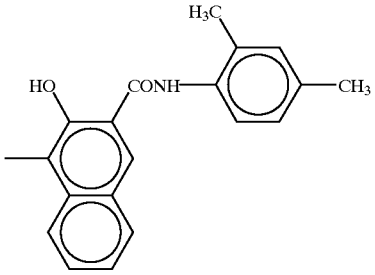 |
| 2-2 | 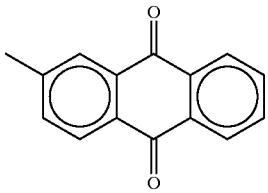 | 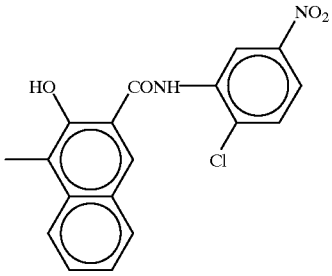 |
| 2-3 | 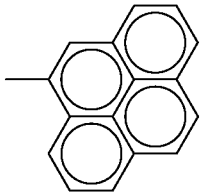 | 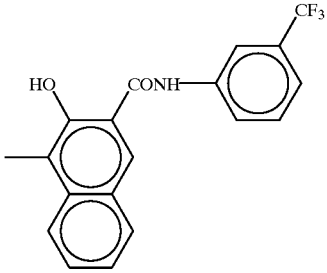 |
| 2-4 | 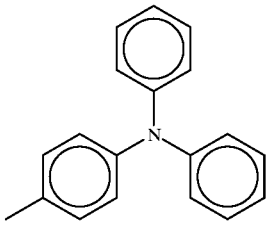 | 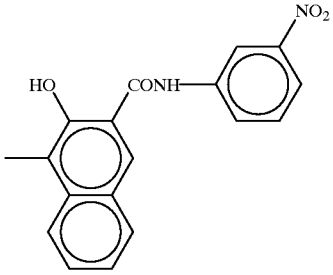 |

*Exemplary Compound

TABLE 2
Cp1—N=N—Ar—N=N—Cp2
(n = 2)
| * | Ar | Cp2 | Cp2 |
|---|---|---|---|
| 2-5 | 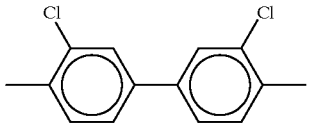 | 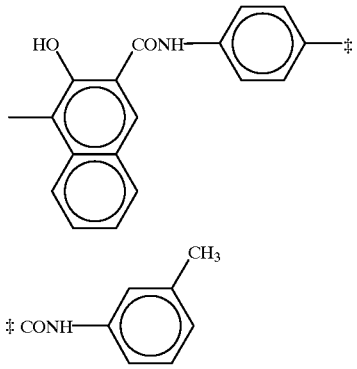 | THE SAME AS Cp1 |
| 2-6 | 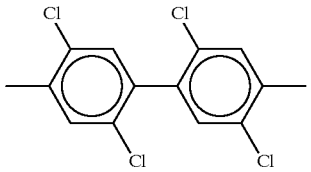 | 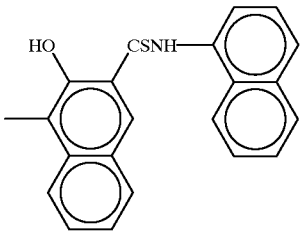 | THE SAME AS Cp1 |
| 2-7 | 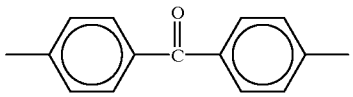 | 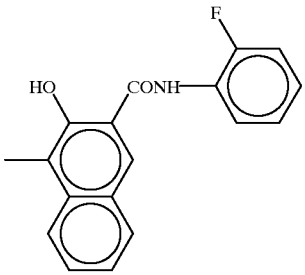 | THE SAME AS Cp1 |
| 2-8 | 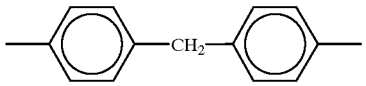 | 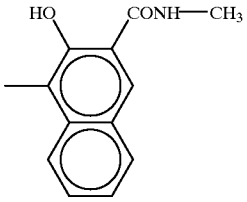 | THE SAME AS Cp1 |
*Exemplary Compound TABLE 3
Cp1—N═N—Ar—N═N—Cp2
(n = 2)
| * | Ar | Cp1 | Cp2 |
|---|---|---|---|
| 2-9 | 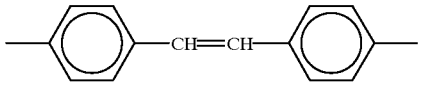 | 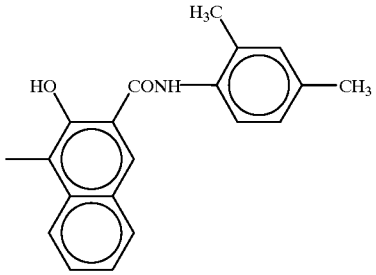 | THE SAME AS Cp1 |
| 2-10 | 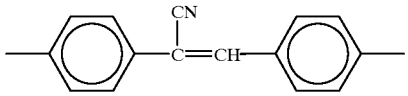 | 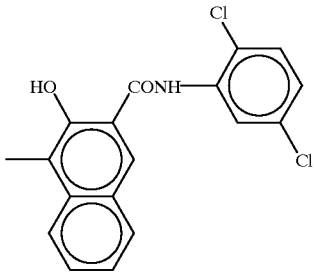 | THE SAME AS Cp1 |
| 2-11 | 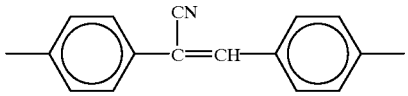 | 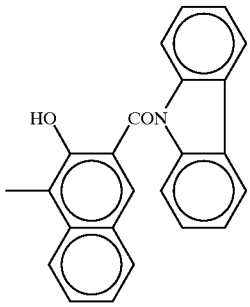 | THE SAME AS Cp1 |
| 2-12 | 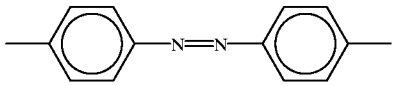 | 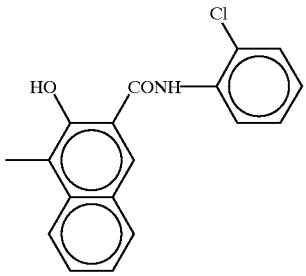 | THE SAME AS Cp1 |
*Exemplary Compound TABLE 4
| * | Ar | Cp1 | Cp2 |
|---|---|---|---|
| | | Cp1—N=N—Ar—N=N—Cp2 (n = 2) | |
| 2-13 | 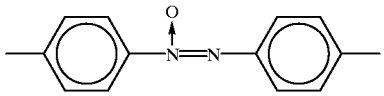 | 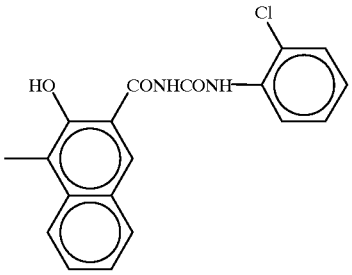 | THE SAME AS Cp1 |
| 2-14 | 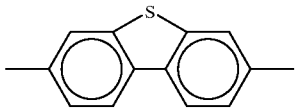 | 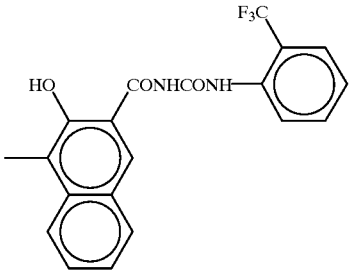 | THE SAME AS Cp1 |
| 2-15 | 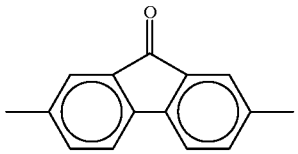 | 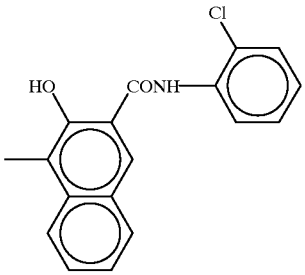 | THE SAME AS Cp1 |
| 2-16 | 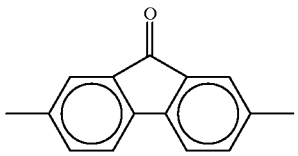 | 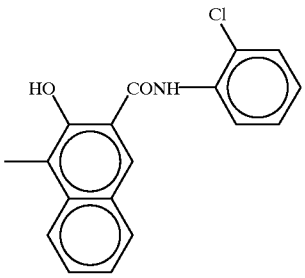 | 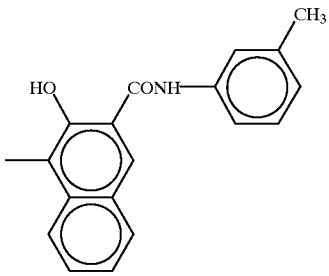 |
*Exemplary Compound
55
60

TABLE 5
Cp1—N=N—Ar—N=N—Cp2
(n = 2)
| * | Ar | Cp1 | Cp2 |
|---|---|---|---|
| 2-17 | 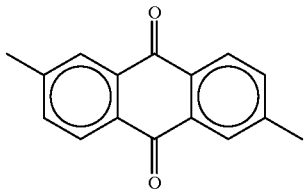 | 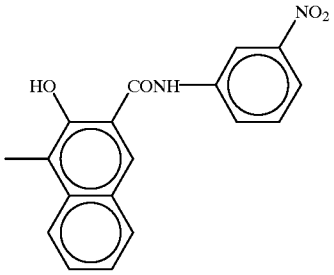 | THE SAME AS Cp1 |
| 2-18 | 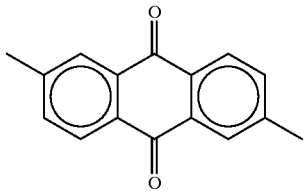 | 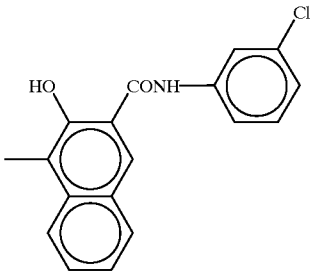 | THE SAME AS Cp1 |
| 2-19 | 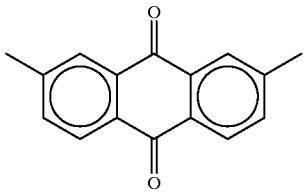 | 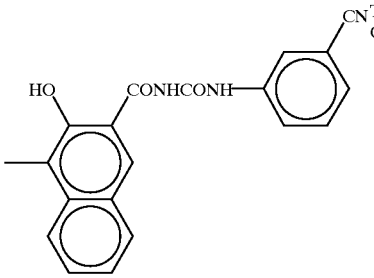 | THE SAME AS Cp1 |
| 2-20 | 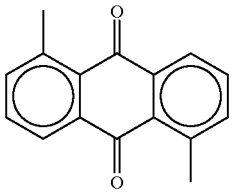 | 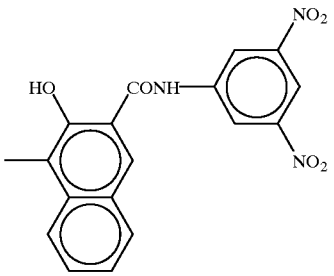 | THE SAME AS Cp1 |
*Exemplary Compound TABLE 6
| * | Ar | Cp1 | Cp2 |
|---|---|---|---|
| | | Cp1—N=N—Ar—N=N—Cp2 (n = 2) | |
| 2-21 | 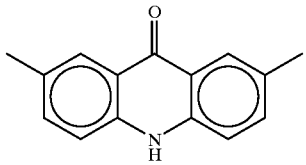 | 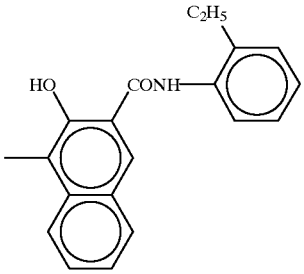 | THE SAME AS Cp1 |
| 2-22 | 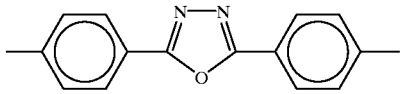 | 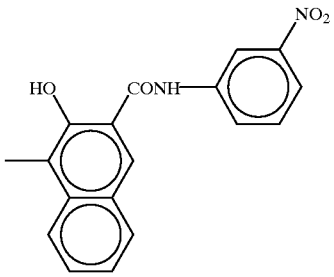 | THE SAME AS Cp1 |
| 2-23 | 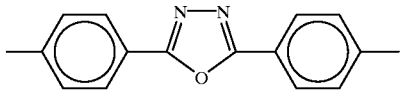 | 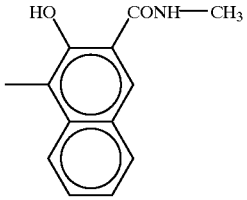 | THE SAME AS Cp1 |
| 2-24 | 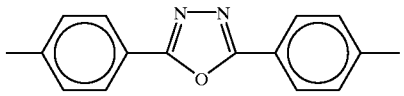 | 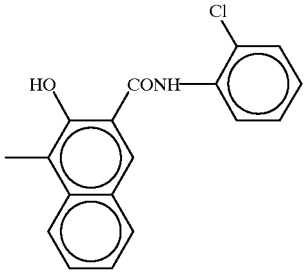 | 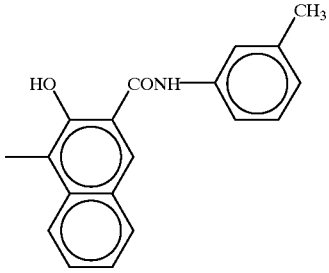 |
*Exemplary Compound TABLE 7
Cp1—N=N—Ar—N=N—Cp2
(n = 2)
| * | Ar | Cp1 | Cp2 |
|---|---|---|---|
| 2-25 | 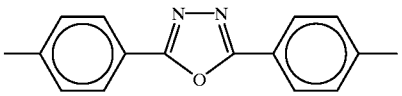 | 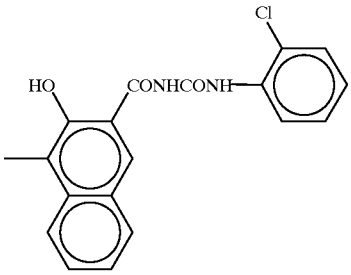 | THE SAME AS Cp1 |
| 2-26 | 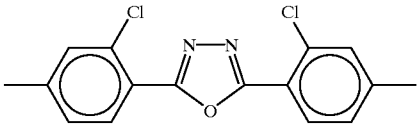 | 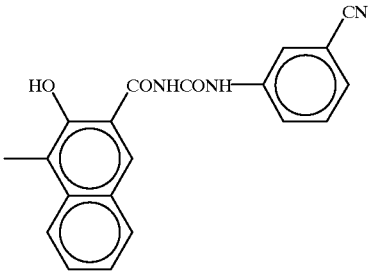 | 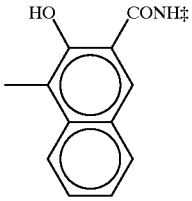 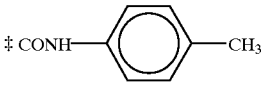 |
| 2-27 | 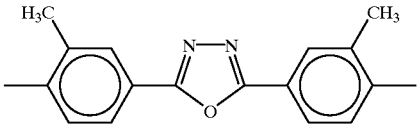 | 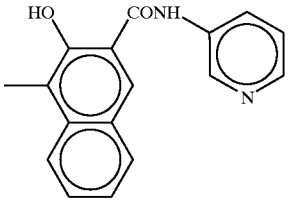 | THE SAME AS Cp1 |
| 2-28 | 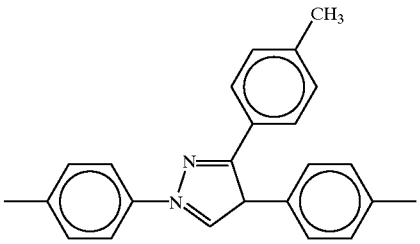 | 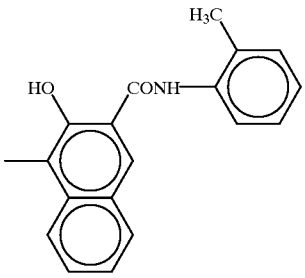 | THE SAME AS Cp1 |
*Ecemplary Compound
55
60

TABLE 8
Cp1—N=N—Ar—N=N—Cp2
(n = 2)
| * | Ar | Cp1 | Cp2 |
|---|---|---|---|
| 2-29 | 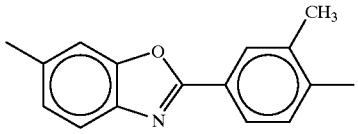 | 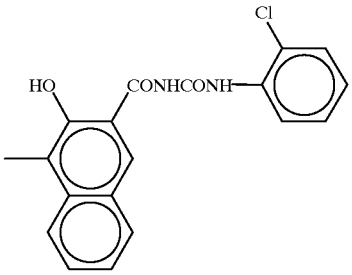 | THE SAME AS Cp1 |
| 2-30 | 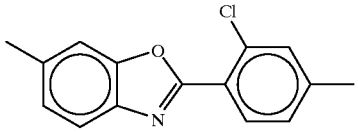 | 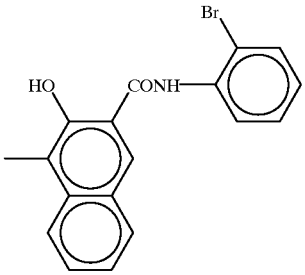 | THE SAME AS Cp1 |
| 2-31 | 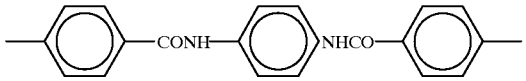 | 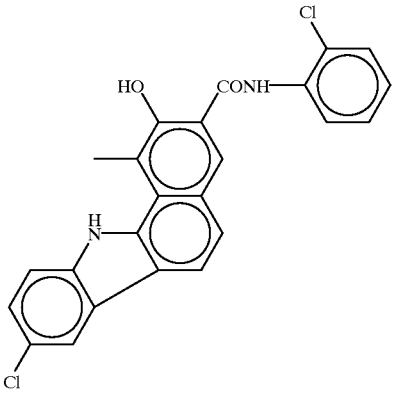 | THE SAME AS Cp1 |
| 2-32 | 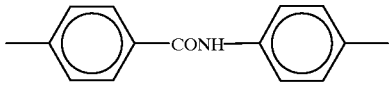 | 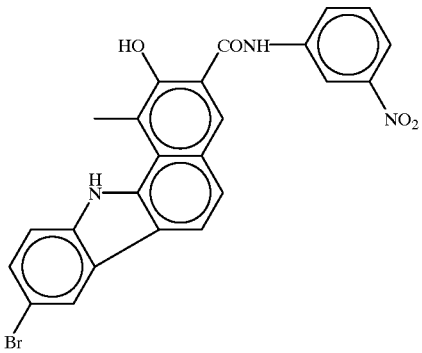 | THE SAME AS Cp1 |
*Exemplary Compound TABLE 9
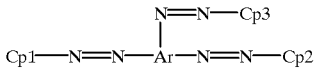
(n = 3)
| * | Ar | Cp1, Cp2, Cp3 |
|---|---|---|
| 2-33 | 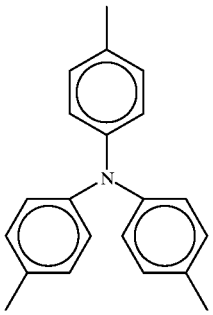 | 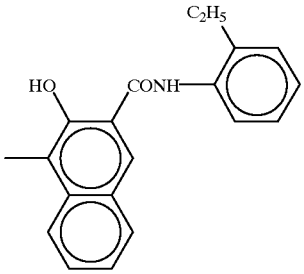 |
*Exemplary Compound
TABLE 10
Ar—N═N—Cp
(n = 1)
| * | Ar | Cp |
|---|---|---|
| 3-1 | 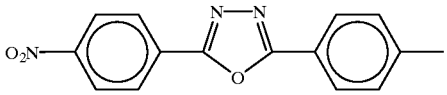 | 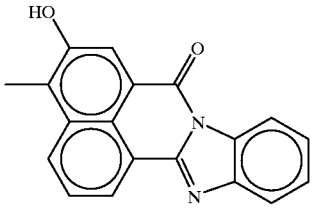 |
| 3-2 | 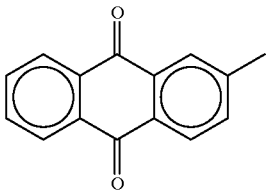 | 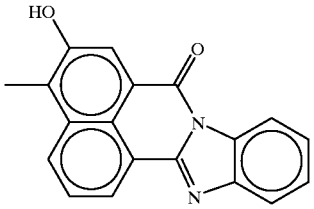 |
| 3-3 | 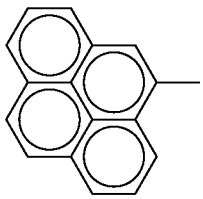 | 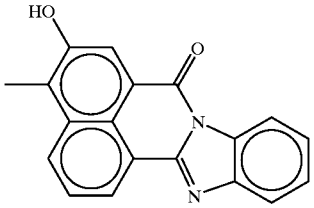 |
*Exemplary Compound TABLE 11
| * | Ar | Cp1—N=N—Ar—N=N—Cp2 (n = 2) Cp1 | Cp2 |
|---|---|---|---|
| 3-4 | 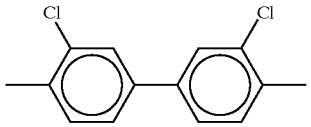 | 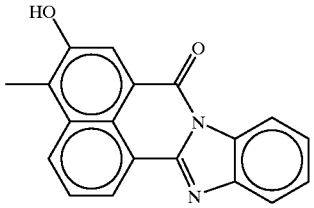 | THE SAME AS Cp1 |
| 3-5 | 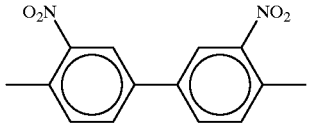 | 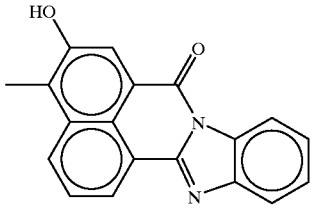 | THE SAME AS Cp1 |
| 3-6 | 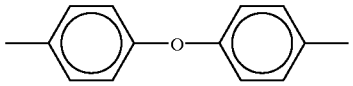 | 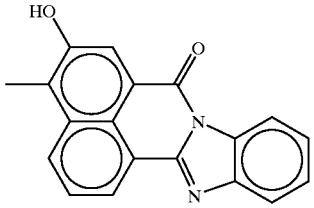 | THE SAME AS Cp1 |
| 3-7 | 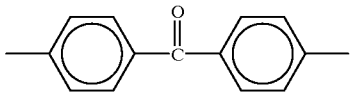 | 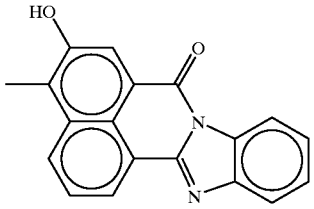 | 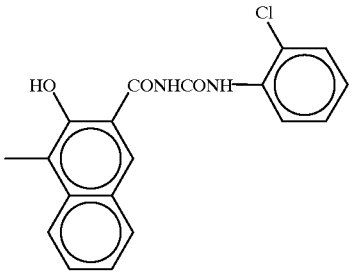 |
| 3-8 | 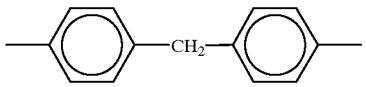 | 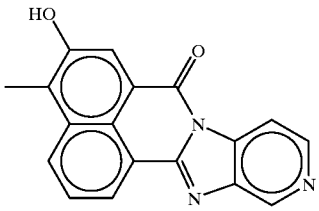 | THE SAME AS Cp1 |
*Exemplary Compound TABLE 12
Cp1—N=N—Ar—N=N—Cp2
(n = 2)
| * | Ar | Cp1 | Cp2 |
|---|---|---|---|
| 3-9 | 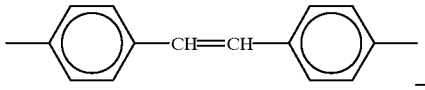 | 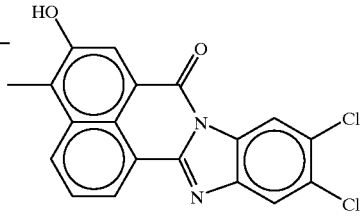 | The same as Cp1 |
| 3-10 | 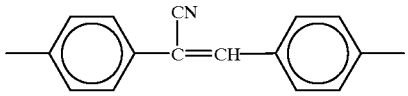 | 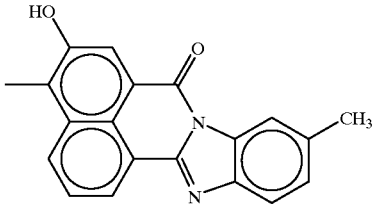 | The same as Cp1 |
| 3-11 | 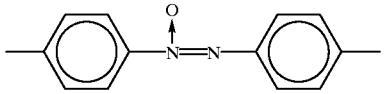 | 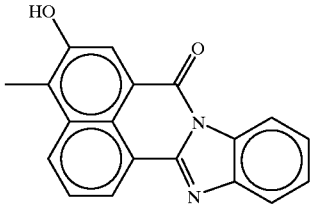 | The same as Cp1 |
| 3-12 | 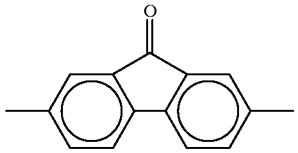 | 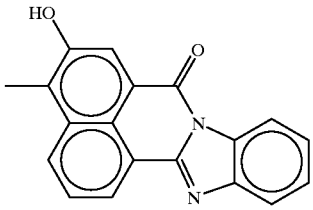 | The same as Cp1 |
| 3-13 | 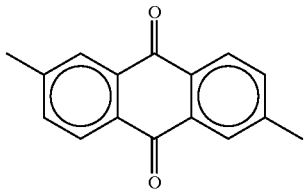 | 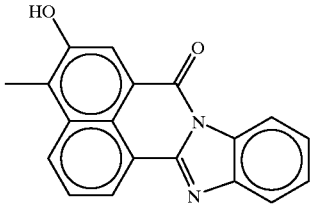 | The same as Cp1 |
*Exemplary Compound TABLE 13
| * | Ar | Cp1 | Cp2 |
|---|---|---|---|
| | | Cp1—N=N—Ar—N=N—Cp2 (n = 2) | |
| 3-14 | 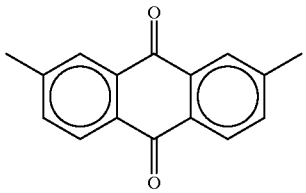 | 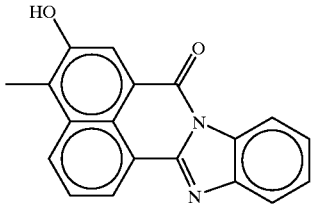 | The same as Cp1 |
| 3-15 | 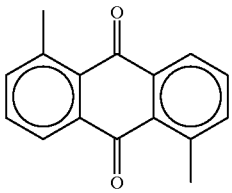 | 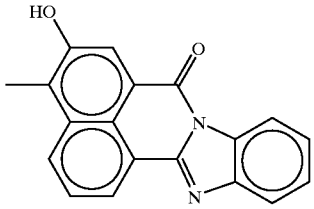 | The same as Cp1 |
| 3-16 | 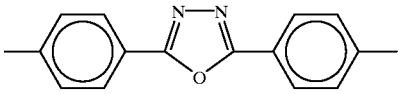 | 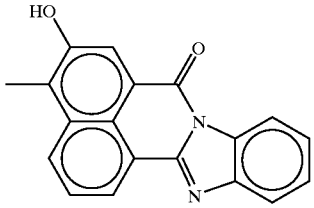 | The same as Cp1 |
| 3-17 | 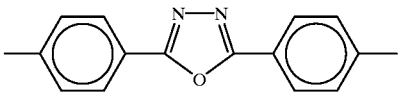 | 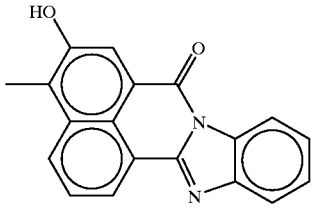 | 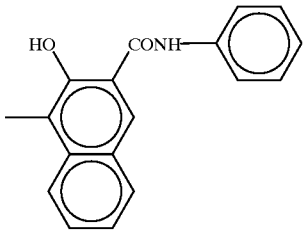 |
| 3-18 | 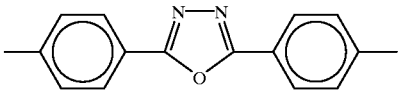 | 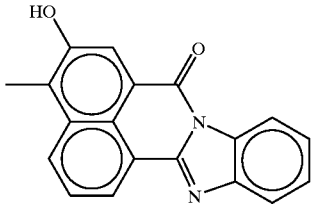 | 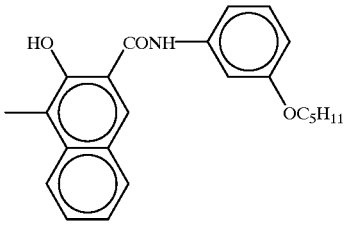 |
*Exemplary Compound TABLE 14
Cp1—N=N—Ar—N=N—Cp2
(n = 2)
| * | Ar | Cp1 | Cp2 |
|---|---|---|---|
| 3-19 | 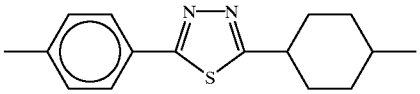 | 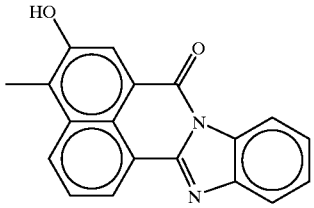 | The same as Cp1 |
| 3-20 | 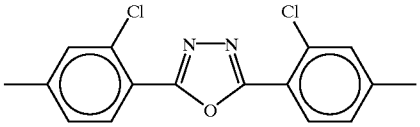 | 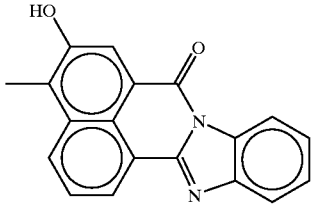 | The same as Cp1 |
| 3-21 | 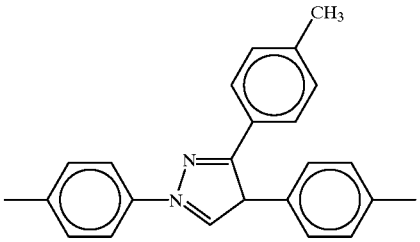 | 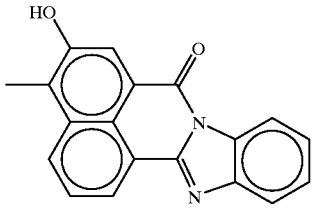 | The same as Cp1 |
| 3-22 | 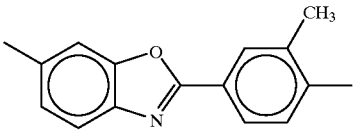 | 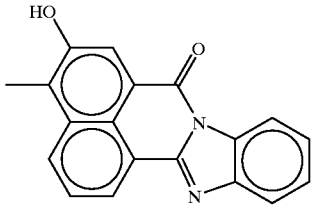 | The same as Cp1 |
| 3-23 | 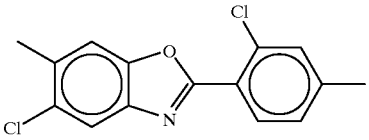 | 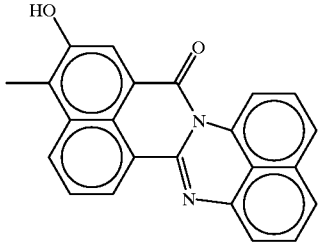 | The same as Cp1 |

TABLE 14-continued
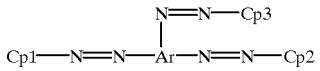
(n = 3)
| * | Ar | Cp1, Cp2, Cp3 |
|---|---|---|
| 3-24 | 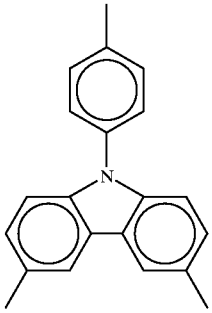 | 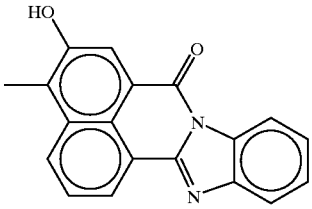 |
*Exemplary Compound
TABLE 1
Ar—N═N—Cp
(n = 1)
| * | Ar | Cp |
|---|---|---|
| 4-1 | 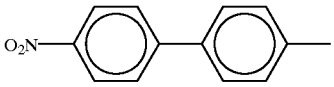 | 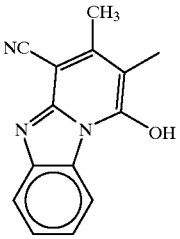 |
| 4-2 | 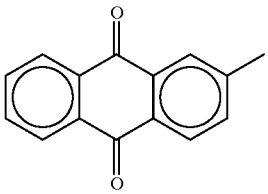 | 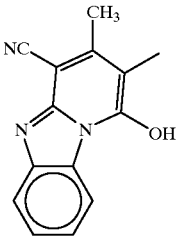 |
TABLE 1-continued
Ar—N═N—Cp
(n = 1)
| * | Ar | Cp |
|---|---|---|
| 4-3 | 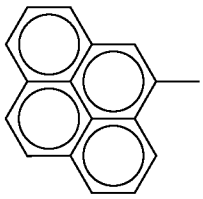 | 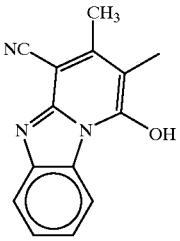 |
*Exemplary Compound TABLE 2
Cp1—N=N—Ar—N=N—Cp2
(n = 2)
| * | Ar | Cp1 | Cp2 |
|---|---|---|---|
| 4-4 | 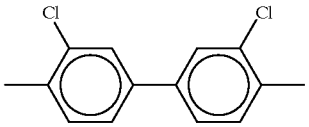 | 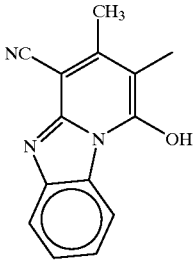 | 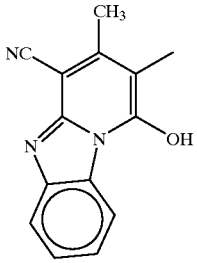 |
| 4-5 | 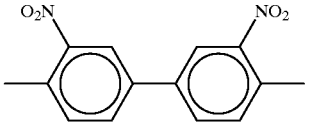 | 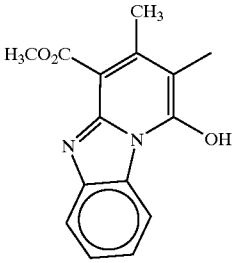 | 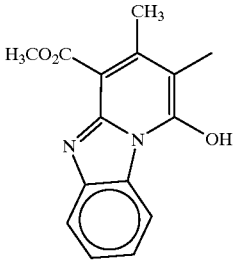 |
| 4-6 | 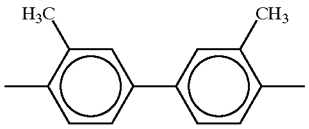 | 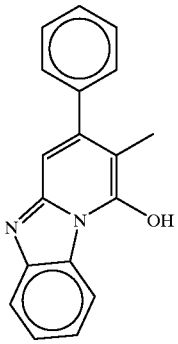 | 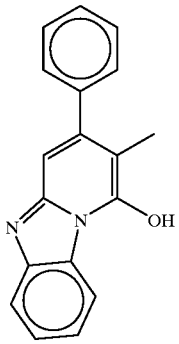 |
| 4-7 | 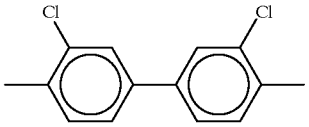 | 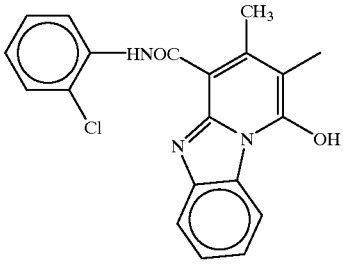 | 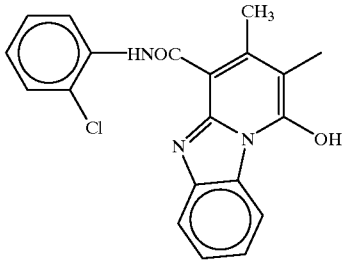 |
| 4-8 | 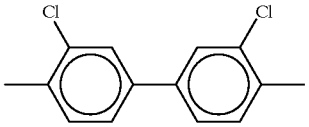 | 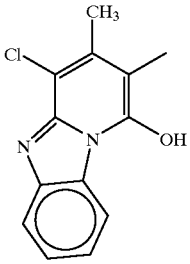 | 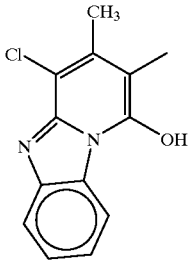 |
*Exemplary Compound TABLE 3
| | Cp1—N=N—Ar—N=N—Cp2 (n = 2) | | |
|---|---|---|---|
| * | Ar | Cp1 | Cp2 |
| 4-9 | 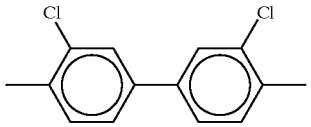 | 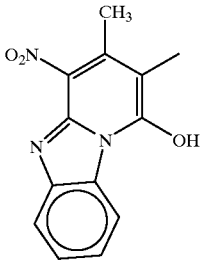 | 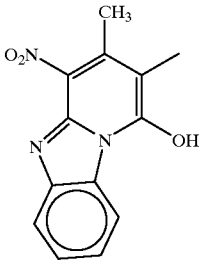 |
| 4-10 | 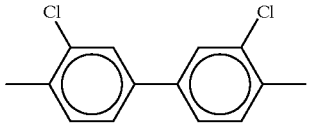 | 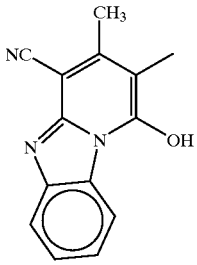 | 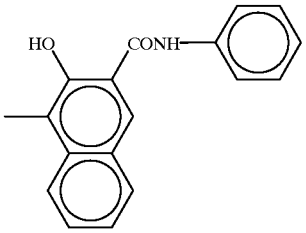 |
| 4-11 | 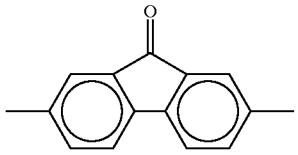 | 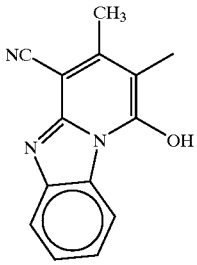 | 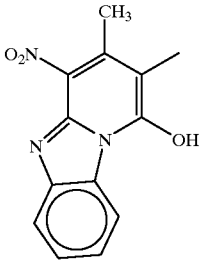 |
| 4-12 | 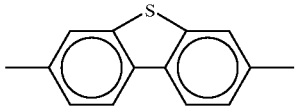 | 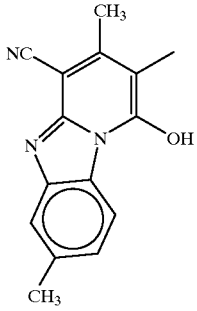 | 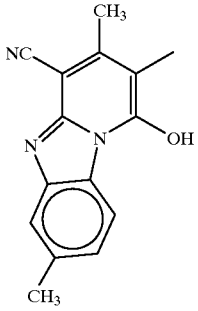 |
| 4-13 | 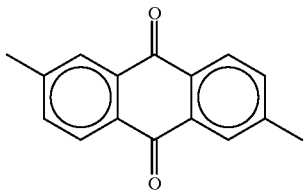 | 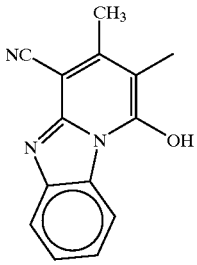 | 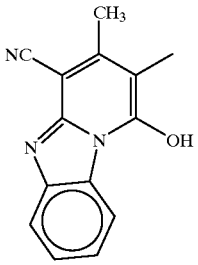 |
*Exemplary Compound TABLE 4
Cp1—N=N—Ar—N=N—Cp2
(n = 2)
| * | Ar | Cp1 | Cp2 |
|---|---|---|---|
| 4-14 | 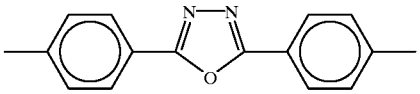 | 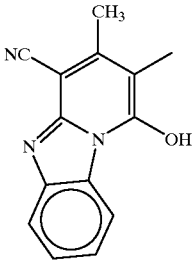 | 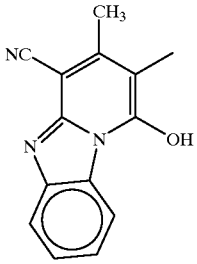 |
| 4-15 | 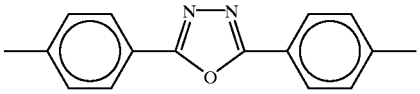 | 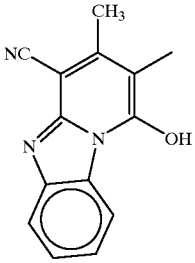 | 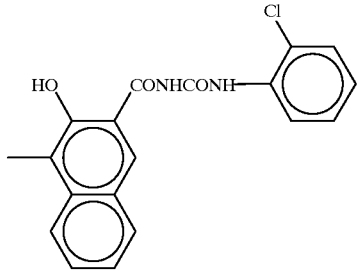 |
| 4-16 | 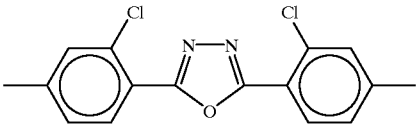 | 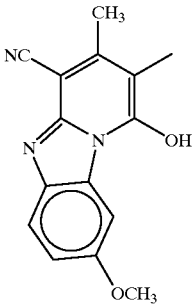 | 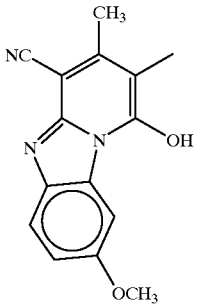 |
| 4-17 | 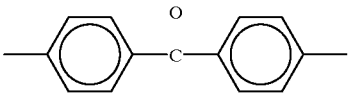 | 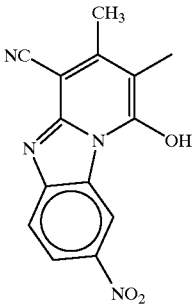 | 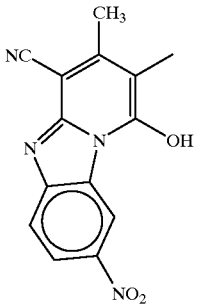 |

TABLE 4-continued
Cp1—N=N—Ar—N=N—Cp2
(n = 2)
| * | Ar | Cp1 | Cp2 |
|---|---|---|---|
| 4-18 | 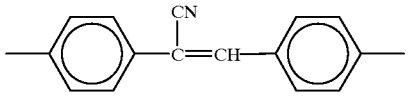 | 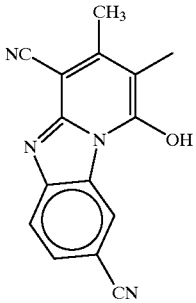 | 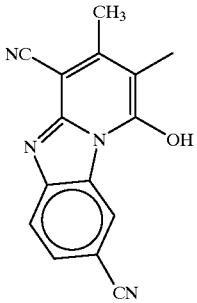 |
*Exemplary Compound
TABLE 5
Cp1—N=N—Ar—N=N—Cp2
(n = 2)
| * | Ar | Cp1 | Cp2 |
|---|---|---|---|
| 4-19 | 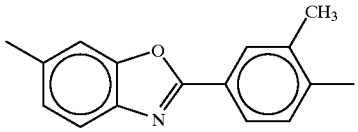 | 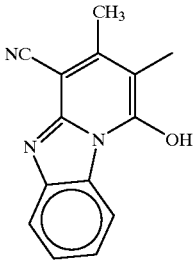 | 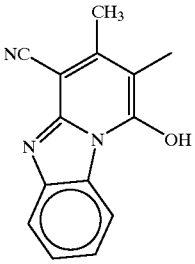 |
*Exemplary Compound
TABLE 6
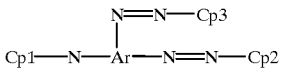
(n = 3)
| 例示化合物 | Cp1, Cp2, Cp3 |
|---|---|
| 4-20 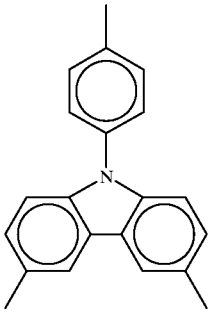 | 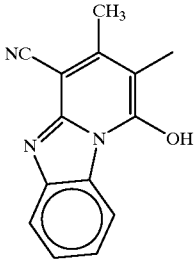 |
*Exemplary Compound TABLE 7
| * | Ar—N=N—Cp (n = 1) Ar | Cp |
|---|---|---|
| 5-1 | 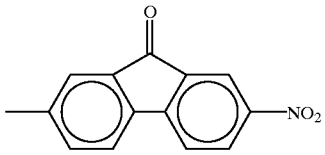 | 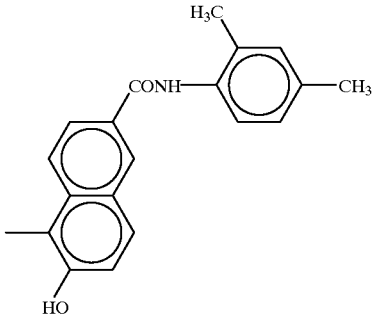 |
| 5-2 | 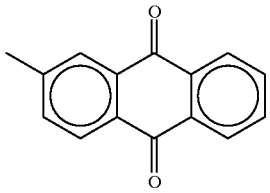 | 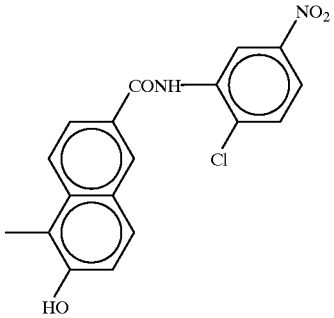 |
| 5-3 | 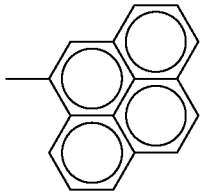 | 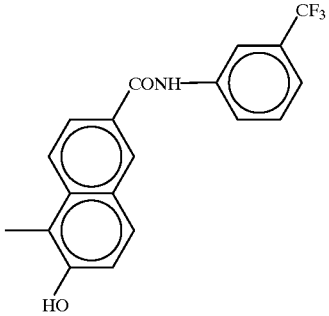 |
| 5-4 | 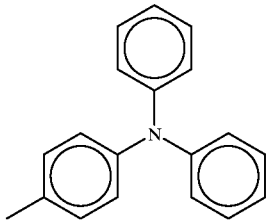 | 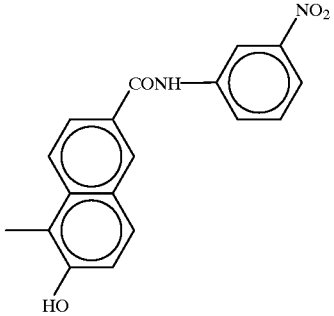 |
*Exemplary Compound TABLE 8
Cp1—N=N—Ar—N=N—Cp2
(n = 2)
| * | Ar | Cp1 | Cp2 |
|---|---|---|---|
| 5-5 | 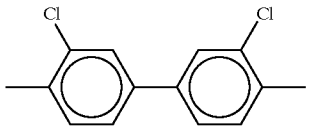 | 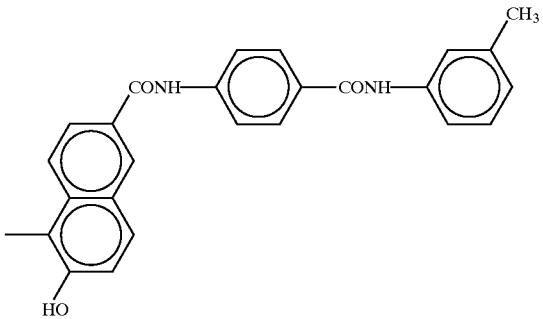 | 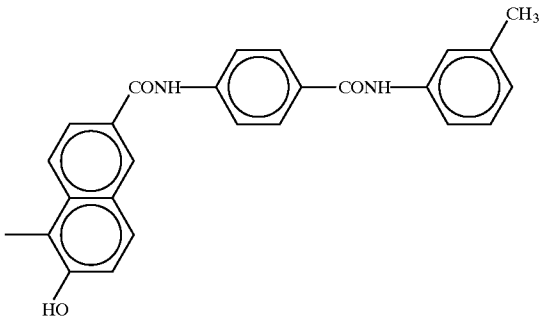 |
| 5-6 | 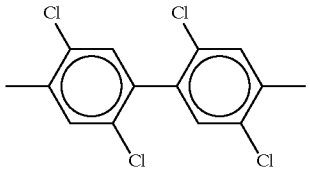 | 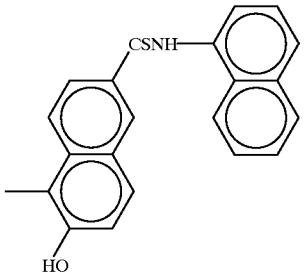 | 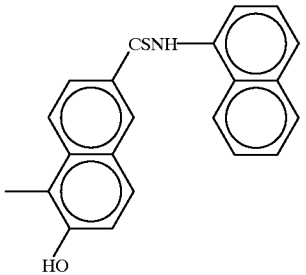 |
| 5-7 | 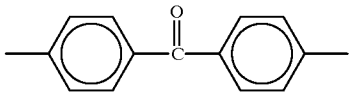 | 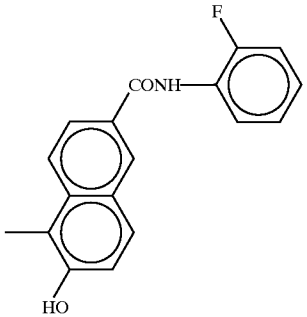 | 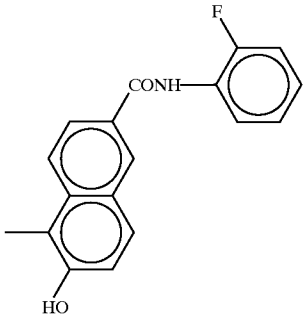 |

TABLE 8-continued
| | Cp1—N=N—Ar—N=N—Cp2 (n = 2) | | |
|---|---|---|---|
| * | Ar | Cp1 | Cp2 |
| 5-8 | 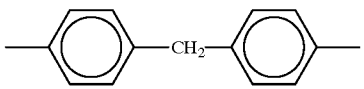 | 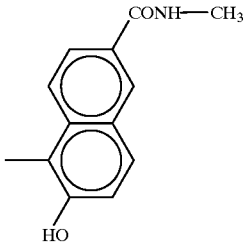 | 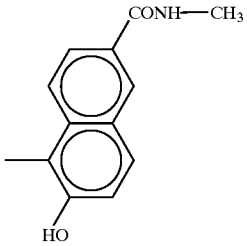 |
| 5-9 | 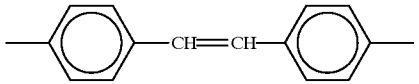 | 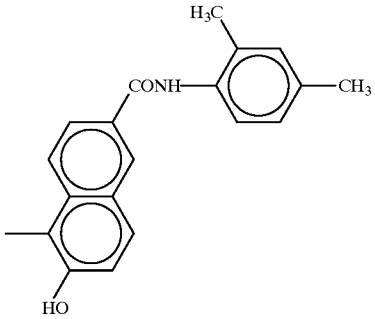 | 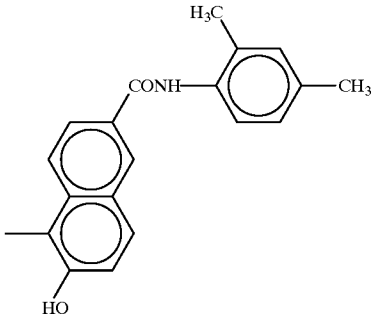 |
*Exemplary Compound TABLE 9
| | Cp1—N=N—Ar—N=N—Cp2 (n = 2) | | |
|---|---|---|---|
| * | Ar | Cp1 | Cp2 |
| 5-10 | 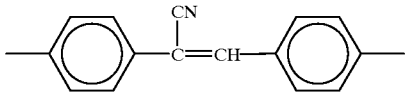 | 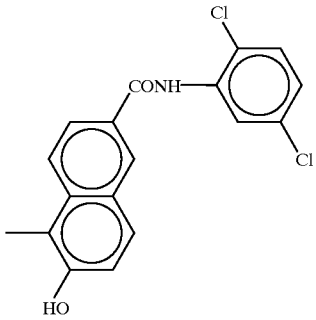 | 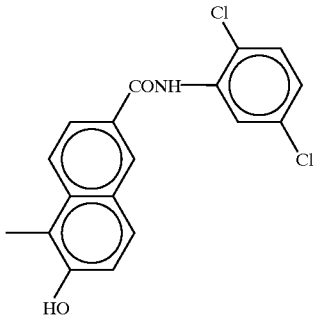 |
| 5-11 | 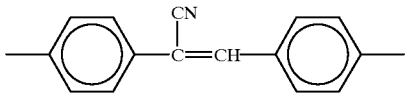 | 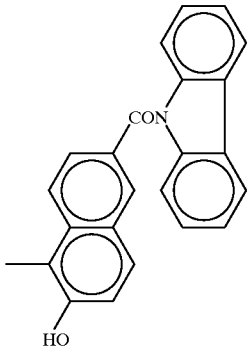 | 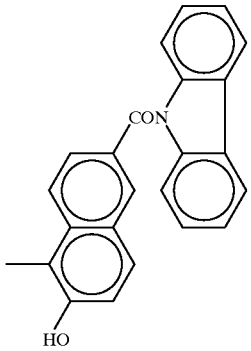 |
| 5-12 | 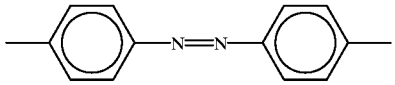 | 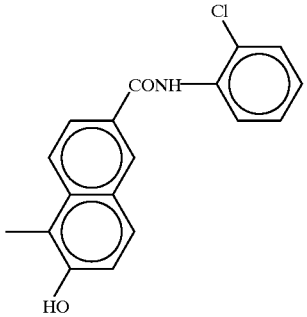 | 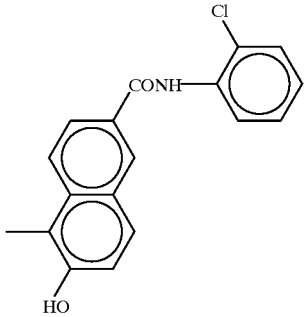 |
| 5-13 | 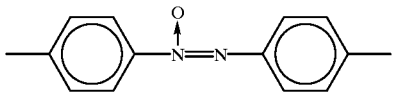 | 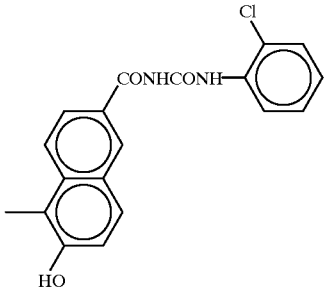 | 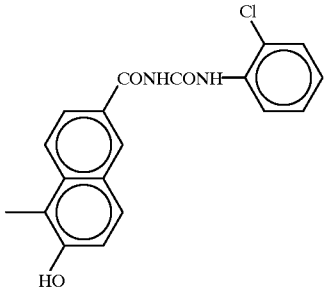 |
*Exemplary Compound TABLE 10
| * | Ar | Cp1 | Cp2 |
|---|---|---|---|
| | Cp1—N=N—Ar—N=N—Cp2 (n = 2) | | |
| 5-14 | 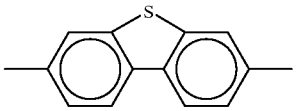 | 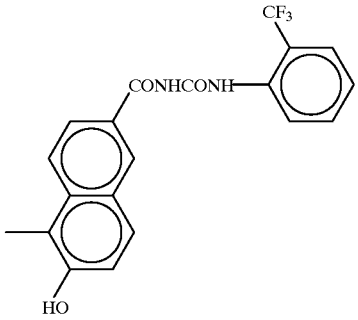 | 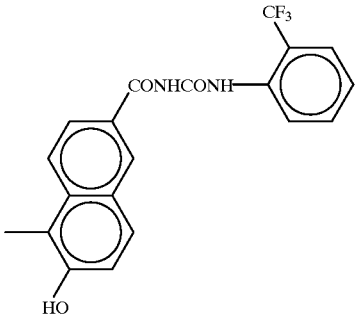 |
| 5-15 | 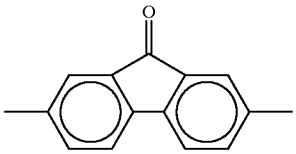 | 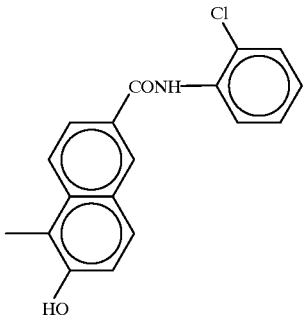 | 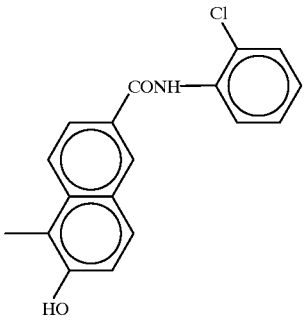 |
| 5-16 | 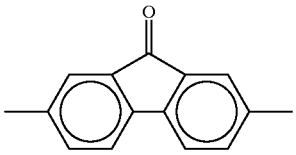 | 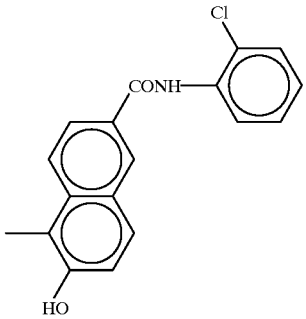 | 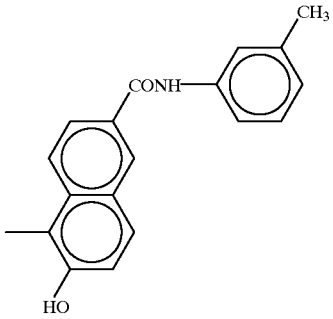 |
| 5-17 | 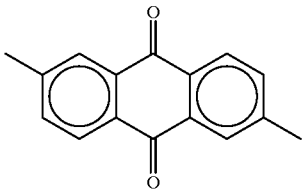 | 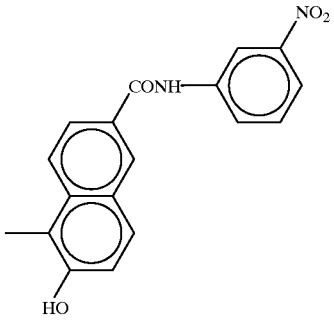 | 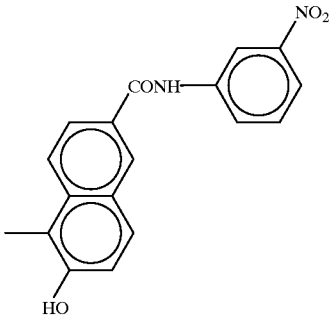 |
*Exemplary Compound TABLE 11
Cp1—N=N—Ar—N=N—Cp2
(n = 2)
| * | Ar | Cp1 | Cp2 |
|---|---|---|---|
| 5-18 | 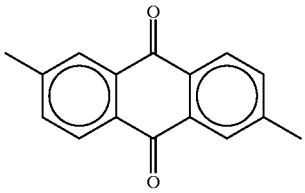 | 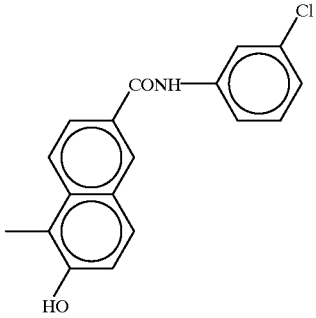 | 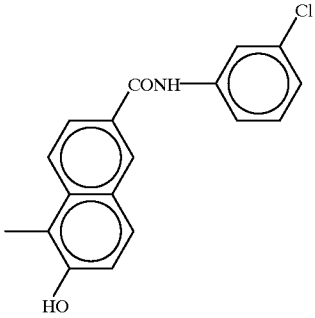 |
| 5-19 | 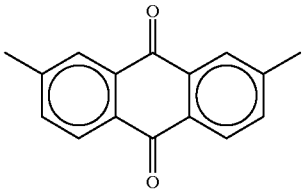 | 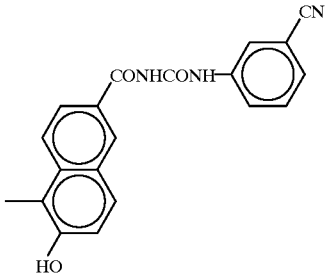 | 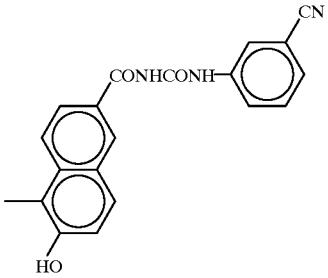 |
| 5-20 | 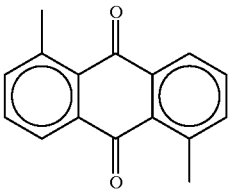 | 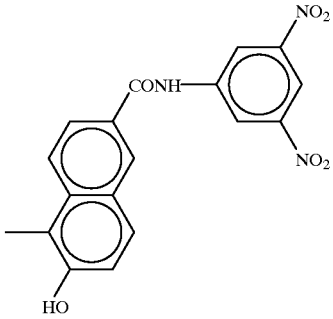 | 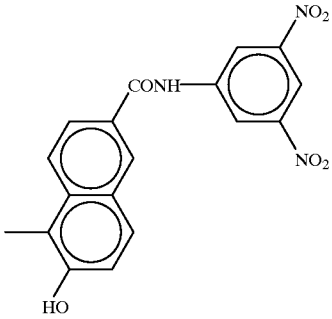 |
| 5-21 | 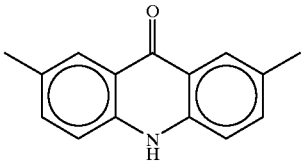 | 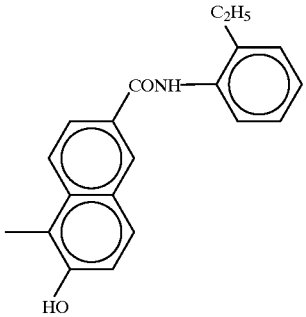 | 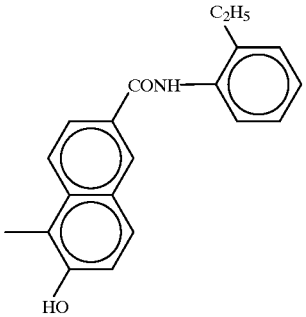 |
*Exemplary Compound TABLE 12
Cp1—N=N—Ar—N=N—Cp2
(n = 2)
| * | Ar | Cp1 | Cp2 |
|---|---|---|---|
| 5-22 | 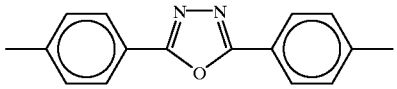 | 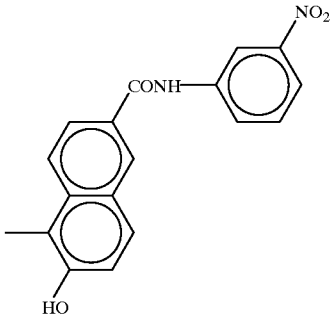 | 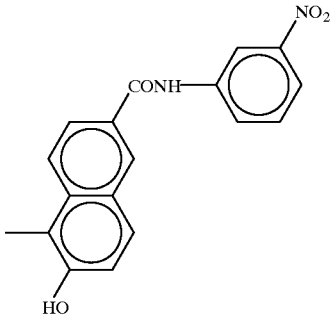 |
| 5-23 | 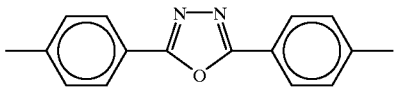 | 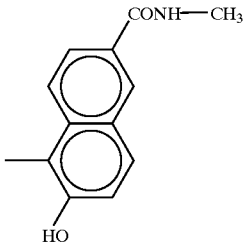 | 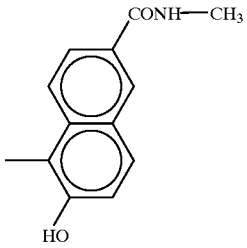 |
| 5-24 | 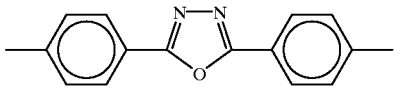 | 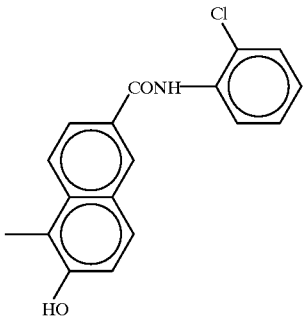 | 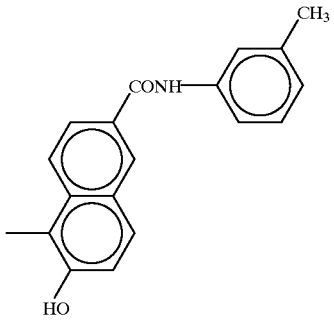 |
| 5-25 | 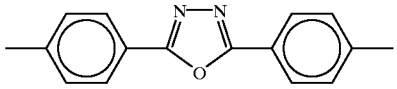 | 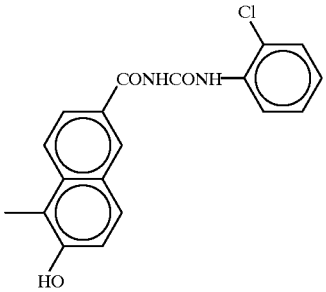 | 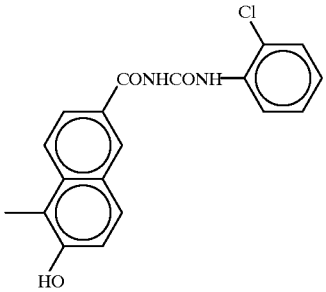 |
*Exemplary Compound TABLE 13
Cp1—N=N—Ar—N=N—Cp2
(n = 2)
| * | Ar | Cp1 | Cp2 |
|---|---|---|---|
| 5-26 | 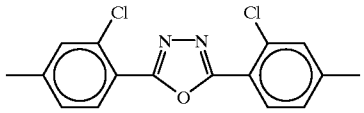 | 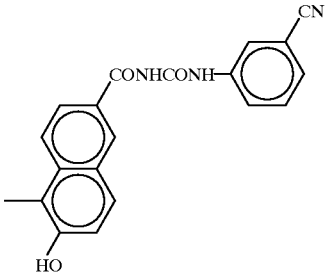 | 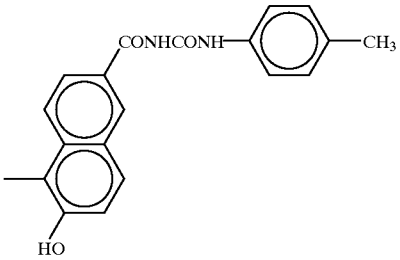 |
| 5-27 | 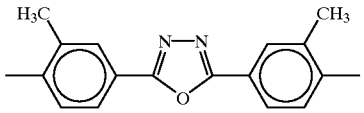 | 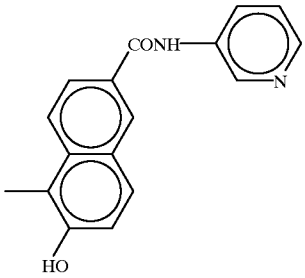 | 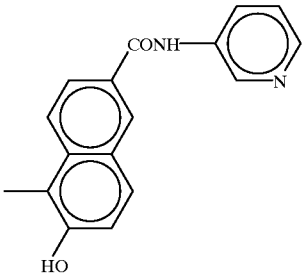 |
| 5-28 | 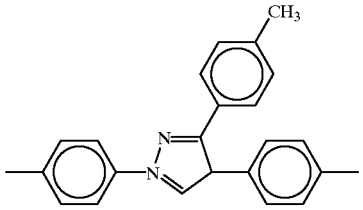 | 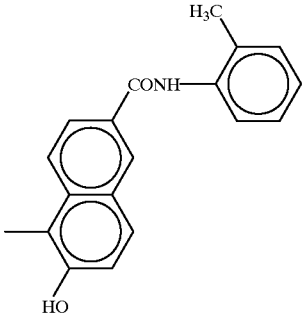 | 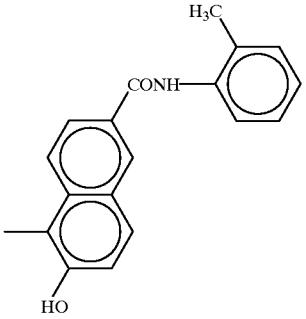 |
| 5-29 | 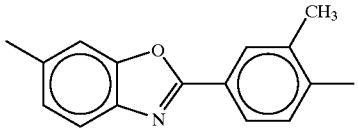 | 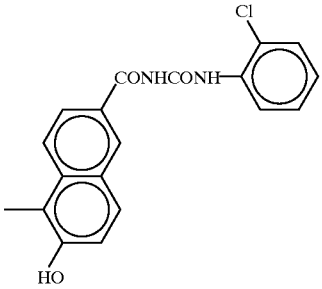 | 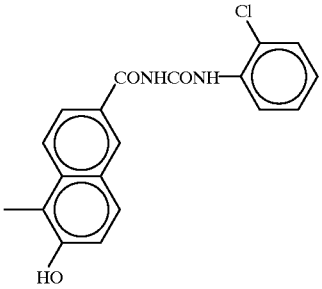 |
*Exemplary Compound TABLE 14
| * | Ar | Cp1—N=N—Ar—N=N—Cp2 (n = 2) Cp1 | Cp2 |
|---|---|---|---|
| 5-30 | 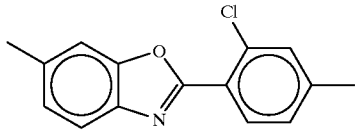 | 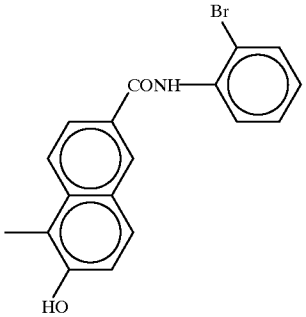 | 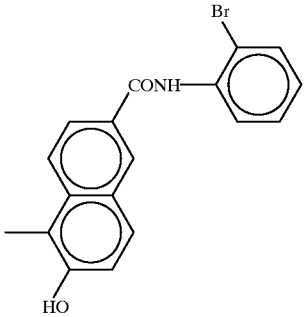 |
| 5-31 | 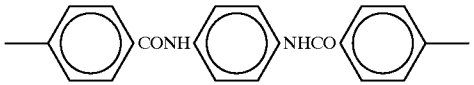 | 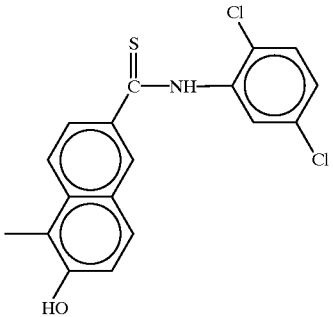 | 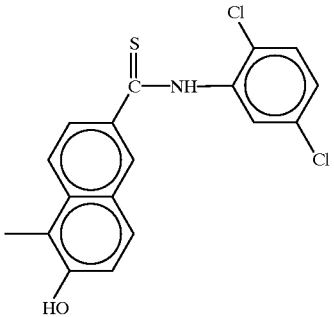 |

TABLE 14-continued
| | | | |
|---|---|---|---|
| 5-32 | 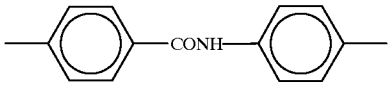 | 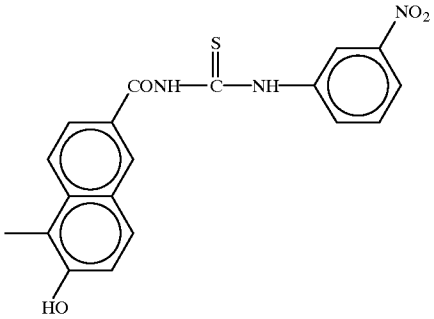 | 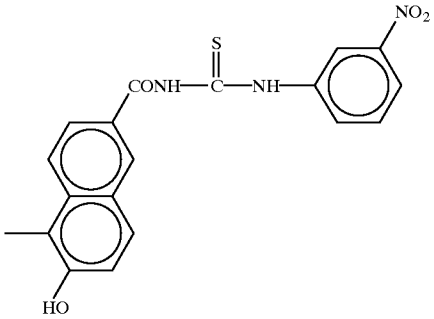 |
| * | Ar | 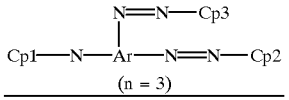 (n = 3) | Cp1, Cp2, Cp3 |
| 5-33 | 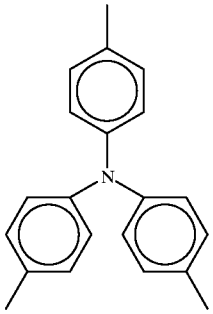 | | 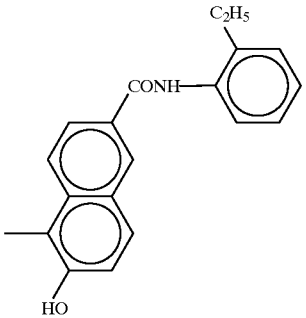 |
*Exemplary Compound Of these, Exemplary Compounds 2-5, 2-13, 2-15, 2-16, 2-25, 2-28, 3-16, 3-17 and 4-4 are preferred, and 2-13, 3-16 and 3-17 are particularly preferred. In view of the stability of sensitivity, 3-16 and 3-17 are more preferred.

The electrophotographic photosensitive member of the present invention will be described below in detail.

Figure 2:
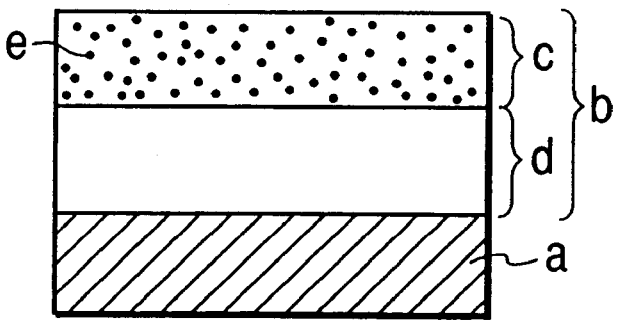
FIG. 2 is a cross-sectional view showing another example of layer configuration of the electrophotographic photosensitive member of the present invention.
Figure 3:
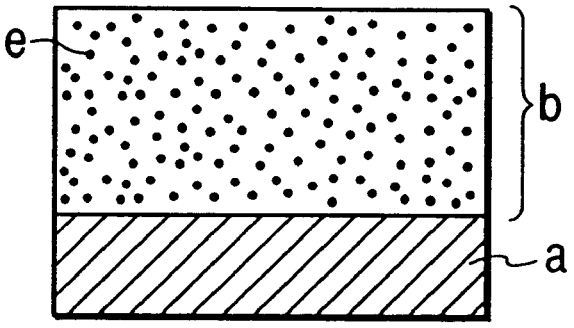
FIG. 3 is a cross-sectional view showing still another example of layer configuration of the electrophotographic photosensitive member of the present invention.

The photosensitive member may have any known layer configuration as shown in FIGS. 1 to 3. Preferred is the configuration as shown in FIG. 1. In FIGS. 1 to 3, letter symbol a denotes a support; b, a photosensitive layer; c, a charge generation layer; d, a charge transport layer; and e, a charge-generating material [the azo pigment represented by Formula (1)]. Japanese Patent Application Laid-Open No. 9-240051 reports that, in the photosensitive member comprising the support and superposed thereon the charge generation layer and the charge transport layer in this order as shown in FIG. 1, the 400 to 500 nm light is absorbed in the charge transport layer before it reaches the charge generation layer, and hence no sensitivity is exhibited in theory. However, it does not necessarily apply. Even the photosensitive member having such layer configuration can have a sufficient sensitivity and can be used, so long as a charge-transporting material having properties of transmitting the light with laser's oscillation wavelength is used as the charge-transporting material used in the charge transport layer.

A function-separated photosensitive member comprising the support and superposed thereon the charge generation layer and the charge transport layer is produced in the manner described below.

The charge generation layer is formed by applying a fluid onto the support by a known method, followed by drying; the fluid being prepared by dispersing as the charge-generating material the azo pigment represented by Formula (1) in a suitable solvent together with a binder resin. The layer may preferably be formed in a thickness not larger than 5 $\mu$m, and particularly preferably from 0.1 to 1 $\mu$m.

The binder resin used may be selected from a vast range of insulating resins or organic photoconductive polymers. It may preferably include polyvinyl butyral, polyvinyl benzal, polyarylates, polycarbonates, polyesters, phenoxy resins, cellulose resins, acrylic resins and polyurethanes. Any of these resins may have a substituent, which substituent may preferably be a halogen atom, an alkyl group, an alkoxyl group, a nitro group, a cyano group or a trifluoromethyl group. The binder resin may be used in an amount of not more than 80% by weight, and particularly preferably not more than 40% by weight, based on the total weight of the charge generation layer.

The solvent used may preferably be selected from those which dissolve the binder resin and do not dissolve the charge transport layer and subbing layer described later. It may specifically include ethers such as tetrahydrofuran and 1,4-dioxane, ketones such as cyclohexanone and methyl ethyl ketone, amides such as N,N-dimethylformamide, esters such as methyl acetate and ethyl acetate, aromatics such as toluene, xylene and chlorobenzene, alcohols such as methanol, ethanol and 2-propanol, and aliphatic halogenated hydrocarbons such as chloroform, methylene chloride, dichloroethylene, carbon tetrachloride and trichloroethylene.

The charge transport layer is laid on or beneath the charge generation layer, and has the function to accept charge carriers from the charge generation layer in the presence of an electric field and transport them. The charge transport layer is formed by applying a solution prepared by dissolving a charge-transporting material in a solvent optionally together with a suitable binder resin. It may preferably have a layer thickness of from 5 to 40 $\mu$m, and particularly preferably from 15 to 30 $\mu$m.

The charge-transporting material can roughly be grouped into an electron transporting material and a hole transporting material. The electron transporting material may include, e.g., electron attractive materials such as 2,4,7-trinitrofluolenone, 2,4,5,7-tetranitrofluolenone, chloranil and tetracyanoquinodimethane, and those obtained by forming these electron attractive materials into polymers. The hole transporting material may include, e.g., polycyclic aromatic compounds such as pyrene and anthracene, heterocyclic compounds such as compounds of carbazole type, indole type, oxazole type, thiazole type, oxadiazole type, pyrazole type, pyrazoline type, thiazole type or triazole type, hydrazone compounds, styryl compounds, benzidine compounds, triarylmethane compounds, triphenylamine compounds, or polymers having a group comprising any of these compounds as the backbone chain or side chain as exemplified by poly-N-vinylcarbazole and polyvinylanthracene.

These charge-transporting materials may be used alone or in combination of two or more. A suitable binder may be used when the charge-transporting material has no film forming properties. It may specifically include insulating resins such as acrylic resins, polyarylates, polycaronates, polyesters, polystyrene, acrylonitrile-styrene copolymer, polyacrylamides, polyamides and chlorinated rubbers, and organic photoconductive polymers such as poly-N-vinylcarbazole and polyvinylanthracene.

When used in the photosensitive member constituted as shown in FIG. 1, charge-transporting materials and binder resins which have transmission properties to the light with oscillation wavelength of semiconductor lasers used must be selected.

The support may be those having a conductivity and may include those made of, e.g., aluminum, an aluminum alloy, copper, zinc, stainless steel, vanadium, molybdenum, chromium, titanium, nickel, indium, gold and platinum. Besides, it is possible to use supports comprised of plastics (e.g., polyethylene, polypropylene, polyvinyl chloride, polyethylene terephthalate and acrylic resins) having a film formed by vacuum deposition of any of these metals or alloys, supports comprising any of the above plastics, metals or alloys coated with conductive particles (e.g., carbon black or silver particles) mixed with a suitable binder resin, and supports comprising plastics or paper impregnated with the conductive particles. The support may be in the form of a drum, a sheet or a belt.

In the present invention, a subbing layer having a barrier function and an adhesion function may be provided between the support and the photosensitive layer.

A protective layer may also be provided for the purpose of protecting the photosensitive layer from any adverse mechanical and chemical effects.

Additives such as an antioxidant and an ultraviolet light absorber may also optionally be used in the photosensitive layer.

In the present invention, any exposure means may be used so long as it has as an exposure light source the semiconductor laser having an oscillation wavelength of 380 nm to 500 nm, and there are no particular limitations on other constitution. Also, there are no particular limitations on the semiconductor laser so long as its oscillation wavelength is within the above range. In the present invention, in view of electrophotographic performance, it is preferable for the semiconductor laser to have an oscillation wavelength of 400 nm to 450 nm.

There are also no particular limitations on the charging means, developing means, transfer means and cleaning means described later.

Figure 4:
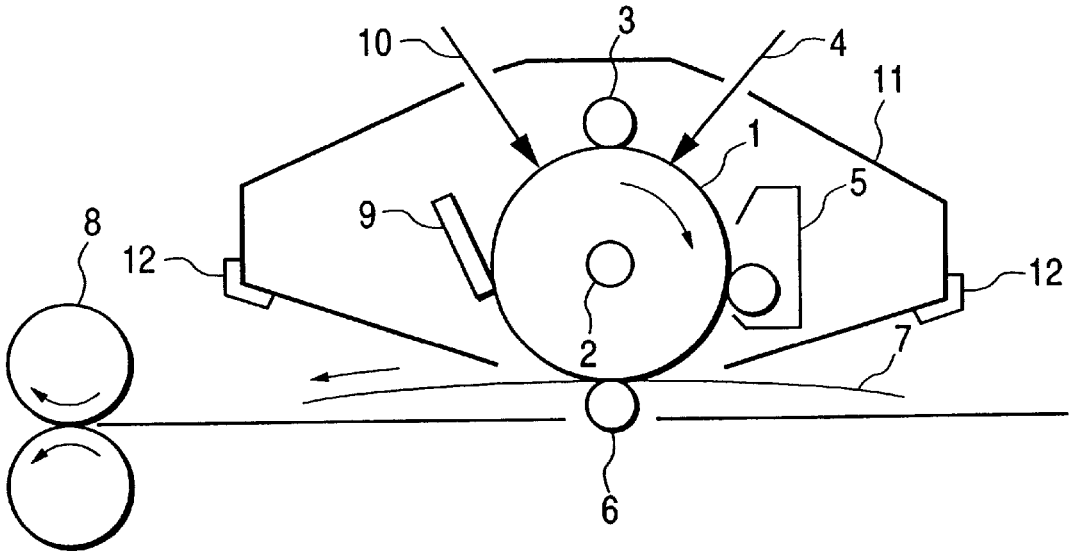
FIG. 4 schematically illustrates the construction of an electrophotographic apparatus having a process cartridge having the electrophotographic photosensitive member of the present invention.

FIG. 4 schematically illustrates the construction of an electrophotographic apparatus having a process cartridge having the electrophotographic photosensitive member of the present invention.

In FIG. 4, reference numeral 1 denotes an electrophotographic photosensitive member of the present invention, which is rotatingly driven around an axis 2 in the direction of an arrow at a given peripheral speed. The photosensitive member 1 is uniformly electrostatically charged on its periphery to a positive or negative, given potential through a primary charging means 3. The photosensitive member thus charged is then exposed to light 4 emitted from an exposure means (not shown) making use of a semiconductor laser having an oscillation wavelength of 380 nm to 500 nm. In this way, electrostatic latent images are successively formed on the periphery of the photosensitive member 1.

The electrostatic latent images thus formed are subsequently developed by toner by the operation of a developing means 5. The resulting toner-developed images are then successively transferred by the operation of a transfer means 6, to the surface of a transfer medium 7 fed from a paper feed section (not shown) to the part between the photosensitive member 1 and the transfer means 6 in the manner synchronized with the rotation of the photosensitive member 1.

The transfer medium 7 to which the images have been transferred is separated from the surface of the photosensitive member, is led to an image fixing means 8, where the images are fixed, and is then printed out of the apparatus as a copied material (a copy).

The surface of the photosensitive member 1 after the transfer of images is brought to removal of the toner remaining after the transfer, through a cleaning means 9. Thus, the photosensitive member is cleaned on its surface, further subjected to charge elimination by pre-exposure light 10 emitted from a pre-exposure means (not shown), and then repeatedly used for the formation of images. In the apparatus shown in FIG. 4, the primary charging means 3 is a contact charging means making use of a charging roller, and hence the pre-exposure is not necessarily required.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, at least one of the primary charging means 3, the developing means 5 and the cleaning means 9 may integrally be supported in a cartridge together with the electrophotographic photosensitive member 1 to form a process cartridge 11 that is detachably mountable to the body of the apparatus through a guide means such as a rail 12 provided in the body of the apparatus.

The present invention will be described below by giving Examples. In Examples, "part(s)" indicates part(s) by weight.

EXAMPLES 1-1 TO 1-10 & COMPARATIVE EXAMPLE 1-1

On an aluminum substrate, a solution prepared by dissolving 5 g of methoxymethylated nylon (weight-average molecular weight: 32,000) and 10 g of alcohol-soluble copolymer nylon (weight-average molecular weight: 29,000) in 95 g of methanol was coated by Mayer-bar coating, followed by drying to form a subbing layer with a layer thickness of 1 $\mu$m.

Next, 5 g of the charge-generating material shown in Table 1-1 was added in a solution prepared by dissolving 2 g of butyral resin (degree of butyralation: 63 mole %; weight-average molecular weight: 35,000) in 95 g of cyclohexanone and was dispersed for 20 hours using a sand mill. The dispersion thus obtained was coated on the subbing layer by Mayer-bar coating, followed by drying to form a charge generation layer with a layer thickness of 0.2 $\mu$m.

Subsequently, a solution prepared by dissolving 5 g of a charge-transporting material represented by the following structural formula:

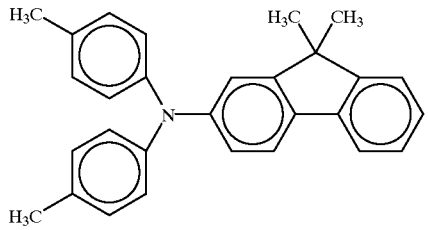

and 5 g of polycarbonate-Z resin (number-average molecular weight: 20,000) in 40 g of monochlorobenzene was coated on the charge generation layer by Mayer-bar coating, followed by drying to form a charge transport layer with a layer thickness of 25 $\mu$m.

Electrophotographic photosensitive members thus produced were evaluated in the following way, using an electrostatic copy paper test apparatus (EPA-8100, manufactured by Kawaguchi Denki).

Sensitivity:

Each photosensitive member was electrostatically charged by a corona charging assembly so as to have a surface potential of −700 V, and then exposed to monochromatic light of 400 nm isolated with a monochromator, where the amount of light necessary for the surface potential to attenuate to −350 V was measured to determine sensitivity (E ½). Sensitivities at monochromatic light of 450 nm and 500 nm were also measured in the same way.

Repetition Performance:

Next, initial dark-area potential (Vd) and initial light-area potential (Vl) were set at about −700 V and −200 V, respectively, and charging and exposure were repeated 3,000 times using monochromatic light of 400 nm to measure variations of Vd and Vl (ΔVd, ΔVl).

Photomemory:

The initial Vd and 400 nm monochromatic light initial Vl of the photosensitive member were set at about −700 V and −200 V, respectively. Then, the photosensitive member was partly irradiated by 400 nm monochromatic light of 20 $\mu W/cm^2$ in light intensity for 15 minutes, and thereafter the Vd and Vl of the photosensitive member was again measured, thus the difference in Vd between non-irradiated areas and irradiated areas ($\Delta Vd_{PM}$) and the difference in Vl between non-irradiated areas and irradiated areas ($\Delta Vl_{PM}$) were measured.

For comparison, an electrophotographic photosensitive member was produced in the same manner as in Example 1-1 except that the charge-generating material was replaced with α-type titanyl phthalocyanine. Evaluation was made similarly.

Results obtained are shown in Table 1-1.

In the following table, the minus signs in the data of repetition performance and photomemory denote a decrease in potential, and the plus signs an increase in potential.

EXAMPLES 1-11 TO 1-20 & COMPARATIVE EXAMPLE 1-2

Electrophotographic photosensitive members were produced in the same manner as in Examples 1-1 to 1-10 and Comparative Example 1-1, respectively, except that the charge-transporting material was replaced with the following compound. Evaluation was made similarly.

Results obtained are shown in Table 1-2.

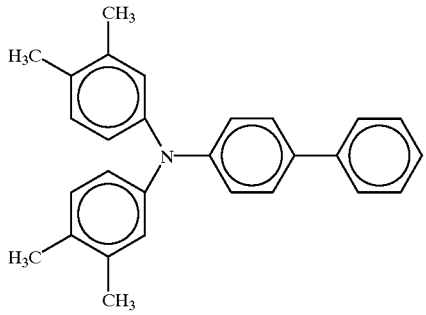

EXAMPLES 1-21 TO 1-30 & COMPARATIVE EXAMPLE 1-3

Electrophotographic photosensitive members were produced in the same manner as in Examples 1-1 to 1-10 and Comparative Example 1-1, respectively, except that the order of the charge generation layer and charge transport layer was reversed. Initial sensitivities were measured in the same manner as in Example 1-1, provided that the charge-transporting material was replaced with a compound having the following structural formula and charge polarity was set positive.

Results obtained are shown in Table 1-3.

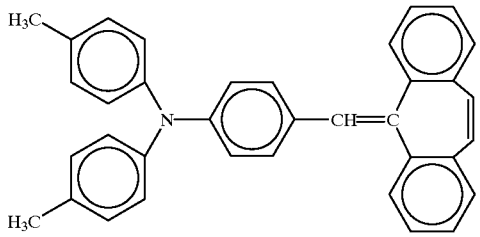

As can be seen from the above results, compared with the photosensitive member of Comparative Example, the electrophotographic photosensitive members of the present invention have a very superior sensitivity in the oscillation wavelength region of short-wavelength lasers, and moreover show a small photomemory for short-wavelength light and have a superior stability in potential in repeated use.

EXAMPLES 1-31 TO 1-36

50 parts of titanium oxide powder coated with tin oxide containing 10% by weight of antimony oxide, 25 parts of resol type phenol resin, 20 parts of methyl cellosolve, 5 parts of methanol and 0.002 part of silicone oil (polydimethylsiloxane-polyoxyalkylene copolymer; average molecular weight: 3,000) were dispersed for 2 hours by means of a sand mill making use of glass beads of 1 mm diameter to prepare a conductive layer coating fluid. This coating fluid was dip-coated on an aluminum cylinder, followed by drying at 140° C. for 30 minutes to form a conductive layer with a layer thickness of 20 $\mu$m.

A solution was prepared by dissolving 5 parts of a 6-66-610-12 polyamide tetrapolymer in a mixed solvent of 70 parts of methanol and 25 parts of butanol. This solution was dip-coated on the conductive layer, followed by drying to form a subbing layer with a layer thickness of 0.8 $\mu$m.

Next, to a solution prepared by dissolving 5 parts of polyvinyl butyral (trade name: S-LEC BM-S; available from Sekisui Chemical Co., Ltd.) in 100 parts of cyclohexanone, 10 parts of the charge-transporting material shown in Table 1-4 was added. The resulting mixture was dispersed for 20 hours by means of a sand mill making use of glass beads of 1 mm diameter. To the dispersion thus obtained, 100 parts of methyl ethyl ketone was further added to dilute it. The dispersion thus obtained was dip-coated on the above subbing layer, followed by drying at 100° C. for 10 minutes to form a charge generation layer with a layer thickness of 0.2 $\mu$m.

Next, 9 parts of a charge-transporting material represented by the following structural formula:

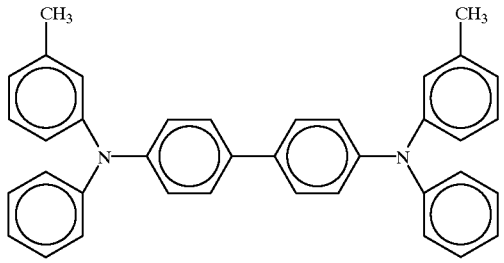

and 10 parts of bisphenol-Z polycarbonate resin (number-average molecular weight: 20,000) were dissolved in 60 parts of monochlorobenzene. The resulting solution was dip-coated on the charge generation layer, followed by drying at a temperature of 110° C. for 1 hour to form a charge transport layer with a layer thickness of 20 $\mu$m. Thus, electrophotographic photosensitive members of Examples 1-31 to 1-36 were produced.

The electrophotographic photosensitive members thus produced were each set in a CANON's printer LBP-2000 modified machine loaded with a pulse-modulating unit (as a light source, loaded with a full-solid blue SHG laser ICD-430, having an oscillation wavelength of 430 nm, manufactured by Hitachi Metals, Ltd.; also modified into a Carlson-type electrophotographic system consisting of charging, exposure, development, transfer and cleaning, adaptable to image input corresponding to 600 dpi in reverse development). The dark-area potential Vd and light-area potential Vl were set at −650 V and −200 V, respectively, and one-dot/one-space images and character (5 point) images were reproduced, and images formed were visually evaluated.

COMPARATIVE EXAMPLE 1-4

An electrophotographic photosensitive member was produced in the same manner as in Example 1-31 except that α-type titanyl phthalocyanine was used as the charge-generating material.

For the photosensitive member thus obtained, images were evaluated in the same manner as in Example 1-31 except that the light source of the evaluation machine was replaced with a GaAs semiconductor laser having an oscillation wavelength of 780 nm.

Results obtained are shown in Table 1-4.

As can be seen from these results, the electrophotographic photosensitive members of the present invention can form images having superior dot reproducibility and character reproducibility and a high resolution.

EXAMPLES 2-1 TO 2-7

Electrophotographic photosensitive members were produced in the same manner as in Example 1-1 except that the charge-generating material was replaced with the charge-generating materials shown in Table 2-1. Evaluation was made similarly.

Results obtained are shown in Table 2-1.

EXAMPLES 2-8 TO 2-14

Electrophotographic photosensitive members were produced in the same manner as in Examples 2-1 to 2-7, respectively, except that the charge-transporting material was replaced with the charge-transporting material used in Example 1-11. Evaluation was made similarly.

Results obtained are shown in Table 2-1.

EXAMPLES 2-15 TO 2-21

Electrophotographic photosensitive members were produced in the same manner as in Examples 2-1 to 2-7, respectively, except that the order of the charge generation layer and charge transport layer was reversed. Initial sensitivities were measured in the same manner as in Example 2-1, provided that the charge-transporting material was replaced with the one used in Example 1-21 and charge polarity was set positive.

Results obtained are shown in Table 2-3.

As can be seen from the above results, compared with the photosensitive member of Comparative Example, the electrophotographic photosensitive members of the present invention have a very superior sensitivity in the oscillation wavelength region of short-wavelength lasers, and moreover a show small photomemory for short-wavelength light and have a superior stability in potential in repeated use.

EXAMPLES 2-22 AND 2-23

Electrophotographic photosensitive members were produced in the same manner as in Example 1-31 except that the charge-generating material was replaced with the charge-generating materials shown in Table 2-4. Evaluation was made similarly.

Results obtained are shown in Table 2-4.

As can be seen from these results, the electrophotographic photosensitive members of the present invention can form images having superior dot reproducibility and character reproducibility and a high resolution.

EXAMPLES 3-1 TO 3-4 & COMPARATIVE EXAMPLE 3-1

Electrophotographic photosensitive members were produced in the same manner as in Example 1-1 except that the charge-generating material was replaced with the charge-generating materials shown in Table 3-1 and the charge generation layer was formed in a layer thickness of 0.25 $\mu$m. Evaluation was made similarly.

Results obtained are shown in Table 3-1.

EXAMPLES 3-5 TO 3-8 & COMPARATIVE EXAMPLE 3-2

Electrophotographic photosensitive members were produced in the same manner as in Example 3-1 to 3-4 and Comparative Example 3-1, respectively, except that the charge-transporting material was replaced with the one used in Example 1-11. Evaluation was made similarly.

Results obtained are shown in Table 3-2.

EXAMPLES 3-9 TO 3-12 & COMPARATIVE EXAMPLE 3-3

Electrophotographic photosensitive members were produced in the same manner as in Examples 3-1 to 3-4 and Comparative Example 3-1, respectively, except that the order of the charge generation layer and charge transport layer was reversed. Initial sensitivities were measured in the same manner as in Example 3-1, provided that the charge-transporting material was replaced with the one used in Example 1-21 and charge polarity was set positive.

Results obtained are shown in Table 3-3.

EXAMPLES 3-13

An electrophotographic photosensitive member was produced in the same manner as in Example 1-31 except that the charge-generating material was replaced with the azo pigment of Exemplary Compound 1-4. Evaluation was made similarly.

Results obtained are shown in Table 3-4.

COMPARATIVE EXAMPLE 3-4

An electrophotographic photosensitive member was produced in the same manner as in Example 3-13 except that $\alpha$-type titanyl phthalocyanine was used as the charge-generating material. For the photosensitive member thus obtained, images were evaluated in the same manner as in Example 3-13 except that the light source of the evaluation machine was replaced with a GaAs semiconductor laser having an oscillation wavelength of 780 nm.

Results obtained are shown in Table 3-4.

As can be seen from these results, the electrophotographic photosensitive members of the present invention can form images having superior dot reproducibility and character reproducibility and a high resolution.

EXAMPLES 4-1 TO 4-5

Electrophotographic photosensitive members were produced in the same manner as in Example 3-1 except that the charge-generating material was replaced with the charge-generating materials shown in Table 4-1. Evaluation was made similarly.

Results obtained are shown in Table 4-1.

EXAMPLES 4-6 TO 4-10

Electrophotographic photosensitive members were produced in the same manner as in Examples 4-1 to 4-5, respectively, except that the order of the charge generation layer and charge transport layer was reversed. Initial sensitivities were measured in the same manner as in Example 4-1, provided that the charge-transporting material was replaced with the one used in Example 1-21 and charge polarity was set positive.

Results obtained are shown in Table 4-2.

As can be seen from the above results, compared with the photosensitive member of Comparative Example, the electrophotographic photosensitive members of the present invention have a very superior sensitivity in the oscillation wavelength region of short-wavelength lasers, and moreover show a small photomemory for short-wavelength light and has a superior stability in potential and sensitivity in repeated use.

EXAMPLES 4-11 AND 4-13

Electrophotographic photosensitive members were produced in the same manner as in Example 1-31 except that the charge-generating material was replaced with those shown in Table 4-3. Evaluation was made similarly.

Results obtained are shown in Table 4-3.

As can be seen from these results, the electrophotographic photosensitive members of the present invention can form images having superior dot reproducibility and character reproducibility and a high resolution.

TABLE 1-1

| | Charge-generating material (Exemplary Comp. No.) | Repetition Sensitivity E 1/2 ($\mu$J/cm$^2$) 400 nm | 450 nm | 500 nm | performance (V) ΔVd | ΔV1 | Photomemory (V) $\Delta Vd_{PM}$ | $\Delta V1_{PM}$ |
|---|---|---|---|---|---|---|---|---|
| Example: | | | | | | | | |
| 1-1 | 2-2 | 1.00 | 0.70 | 0.65 | −25 | −15 | −20 | −10 |
| 1-2 | 2-5 | 0.41 | 0.31 | 0.28 | −15 | −10 | −10 | −5 |
| 1-3 | 2-13 | 0.58 | 0.40 | 0.30 | −10 | 0 | −5 | −5 |
| 1-4 | 2-15 | 0.62 | 0.42 | 0.35 | −20 | −5 | −15 | −10 |
| 1-5 | 2-16 | 0.42 | 0.30 | 0.25 | −25 | −10 | −15 | −10 |
| 1-6 | 2-17 | 1.12 | 0.82 | 0.71 | −30 | −15 | −20 | −10 |
| 1-7 | 2-22 | 1.21 | 0.78 | 0.68 | −25 | −20 | −15 | −15 |
| 1-8 | 2-25 | 0.95 | 0.63 | 0.45 | −20 | +5 | −15 | −10 |
| 1-9 | 2-28 | 0.83 | 0.55 | 0.40 | −20 | −15 | −20 | −20 |
| 1-10 | 2-29 | 0.96 | 0.65 | 0.50 | −15 | −5 | −15 | −10 |
| Comparative Example: | | | | | | | | |
| 1-1 | α-type titanyl phthalo-cyanine | 1.35 | 4.11 | 3.10 | −105 | −80 | −230 | −150 |

TABLE 1-2

| | Charge-generating material (Exemplary Comp. No.) | Repetition Sensitivity E 1/2 ($\mu$J/cm$^2$) 400 nm | 450 nm | 500 nm | performance (V) ΔVd | ΔV1 | Photomemory (V) $\Delta Vd_{PM}$ | $\Delta V1_{PM}$ |
|---|---|---|---|---|---|---|---|---|
| Example: | | | | | | | | |
| 1-11 | 2-2 | 0.95 | 0.65 | 0.61 | −30 | −15 | −25 | −15 |
| 1-12 | 2-5 | 0.38 | 0.29 | 0.25 | −25 | −5 | −20 | −10 |
| 1-13 | 2-13 | 0.55 | 0.37 | 0.28 | −15 | +5 | −10 | −5 |
| 1-14 | 2-15 | 0.60 | 0.39 | 0.33 | −25 | −10 | −20 | 0 |
| 1-15 | 2-16 | 0.39 | 0.29 | 0.23 | −30 | −20 | −20 | −5 |
| 1-16 | 2-17 | 1.05 | 0.79 | 0.69 | −35 | −10 | −20 | −10 |
| 1-17 | 2-22 | 1.07 | 0.75 | 0.66 | −25 | −10 | −15 | −5 |
| 1-18 | 2-25 | 0.90 | 0.60 | 0.44 | −20 | 0 | −20 | −10 |
| 1-19 | 2-28 | 0.78 | 0.52 | 0.38 | −25 | −10 | −25 | −15 |
| 1-20 | 2-29 | 0.91 | 0.63 | 0.47 | −20 | +10 | −15 | −5 |
| Comparative Example: | | | | | | | | |
| 1-2 | α-type titanyl phthalo-cyanine | 1.30 | 4.06 | 3.07 | −120 | −75 | −230 | −150 |

TABLE 1-3

| | Charge-generating material (Exemplary Comp. No.) | Sensitivity E 1/2 ($\mu J/cm^2$) 400 nm | 450 nm | 500 nm |
|---|---|---|---|---|
| Example: | | | | |
| 1-21 | 2-2 | 1.20 | 0.84 | 0.78 |
| 1-22 | 2-5 | 0.49 | 0.37 | 0.34 |
| 1-23 | 2-13 | 0.70 | 0.48 | 0.36 |
| 1-24 | 2-15 | 0.74 | 0.50 | 0.42 |
| 1-25 | 2-16 | 0.50 | 0.36 | 0.30 |
| 1-26 | 2-17 | 1.34 | 0.98 | 0.85 |
| 1-27 | 2-22 | 1.45 | 0.94 | 0.82 |
| 1-28 | 2-25 | 1.14 | 0.76 | 0.54 |
| 1-29 | 2-28 | 1.00 | 0.66 | 0.48 |
| 1-30 | 2-29 | 1.15 | 0.78 | 0.61 |
| Comparative Example: | | | | |
| 1-3 | α-type titanyl phthalocyanine | 1.62 | 4.93 | 3.68 |

TABLE 1-4

| | Charge-Generating material (Exemplary Comp. No.) | Dot reproducibility | Character reproducibility |
|---|---|---|---|
| Example: | | | |
| 1-31 | 2-5 | sharp | sharp |
| 1-32 | 2-13 | sharp | sharp |
| 1-33 | 2-15 | sharp | sharp |
| 1-34 | 2-16 | sharp | sharp |
| 1-35 | 2-25 | sharp | sharp |
| 1-36 | 2-28 | sharp | sharp |
| Comparative Example: | | | |
| 1-4 | α-type titanyl phthalocyanine | not reproduced | unsharp (trailed in the direction of secondary scanning) |

TABLE 2-1

| | Charge-generating material (Exemplary Comp. No.) | Repetition Sensitivity E 1/2 ($\mu J/cm^2$) 400 nm | 450 nm | 500 nm | performance (V) ΔVd | ΔV1 | Photomemory (V) $\Delta Vd_{PM}$ | $\Delta V1_{PM}$ |
|---|---|---|---|---|---|---|---|---|
| Example: | | | | | | | | |
| 2-1 | 3-4 | 0.81 | 0.65 | 0.60 | −45 | −20 | −30 | −25 |
| 2-2 | 3-7 | 0.75 | 0.62 | 0.60 | −40 | −25 | −25 | −20 |
| 2-3 | 3-13 | 0.62 | 0.58 | 0.55 | −35 | −20 | −20 | −20 |
| 2-4 | 3-16 | 0.56 | 0.42 | 0.45 | −20 | −10 | −10 | −5 |
| 2-5 | 3-17 | 0.31 | 0.25 | 0.25 | −25 | −15 | −10 | −10 |
| 2-6 | 3-20 | 0.56 | 0.51 | 0.48 | −30 | −5 | −20 | −10 |
| 2-7 | 3-22 | 0.64 | 0.57 | 0.55 | −30 | +10 | −15 | −10 |

TABLE 2-2

| | Charge-generating material (Exemplary Comp. No.) | Repetition Sensitivity E 1/2 ($\mu J/cm^2$) 400 nm | 450 nm | 500 nm | performance (V) ΔVd | ΔV1 | Photomemory (V) $\Delta Vd_{PM}$ | $\Delta V1_{PM}$ |
|---|---|---|---|---|---|---|---|---|
| Example: | | | | | | | | |
| 2-8 | 3-4 | 0.75 | 0.59 | 0.54 | −35 | −15 | −20 | −15 |
| 2-9 | 3-7 | 0.68 | 0.56 | 0.55 | −30 | −20 | −25 | −20 |
| 2-10 | 3-13 | 0.56 | 0.51 | 0.48 | −20 | −10 | −15 | −10 |
| 2-11 | 3-16 | 0.51 | 0.38 | 0.41 | −15 | +5 | −10 | −5 |
| 2-12 | 3-17 | 0.29 | 0.23 | 0.22 | −10 | +5 | −10 | 0 |
| 2-13 | 3-20 | 0.54 | 0.46 | 0.43 | −30 | −15 | −25 | −10 |
| 2-14 | 3-22 | 0.58 | 0.51 | 0.50 | −25 | −5 | −25 | −15 |

TABLE 2-3

| | Charge-generating material (Exemplary Comp. No.) | Sensitivity E 1/2 ($\mu$J/cm$^2$) 400 nm | 450 nm | 500 nm |
|---|---|---|---|---|
| Example: | | | | |
| 2-15 | 3-4 | 1.05 | 0.85 | 0.78 |
| 2-16 | 3-7 | 0.98 | 0.81 | 0.77 |
| 2-17 | 3-13 | 0.81 | 0.75 | 0.72 |
| 2-18 | 3-16 | 0.73 | 0.55 | 0.58 |
| 2-19 | 3-17 | 0.40 | 0.33 | 0.32 |

TABLE 2-3-continued

| | Charge-generating material (Exemplary Comp. No.) | Sensitivity E 1/2 ($\mu$J/cm$^2$) 400 nm | 450 nm | 500 nm |
|---|---|---|---|---|
| 2-20 | 3-20 | 0.77 | 0.66 | 0.86 |
| 2-21 | 3-22 | 0.83 | 0.74 | 0.72 |

TABLE 2-4

| | Charge-Generating material (Exemplary Comp. No.) | Dot reproducibility | Character reproducibility |
|---|---|---|---|
| Example: | | | |
| 2-22 | 3-16 | sharp | sharp |
| 2-23 | 3-17 | sharp | sharp |

TABLE 3-1

| | Charge-generating material (Exemplary Comp. No.) | Repetition Sensitivity E 1/2 ($\mu$J/cm$^2$) 400 nm | 450 nm | 500 nm | performance (V) $\Delta$Vd | $\Delta$V1 | Photomemory (V) $\Delta Vd_{PM}$ | $\Delta V1_{PM}$ |
|---|---|---|---|---|---|---|---|---|
| Example: | | | | | | | | |
| 3-1 | 4-4 | 0.71 | 0.43 | 0.38 | −30 | −10 | −25 | −15 |
| 3-2 | 4-11 | 1.12 | 0.82 | 0.70 | −45 | −15 | −35 | −25 |
| 3-3 | 4-13 | 0.82 | 0.50 | 0.45 | −40 | −10 | −30 | −20 |
| 3-4 | 4-14 | 0.85 | 0.55 | 0.45 | −35 | −20 | −40 | −25 |
| Comparative Example: | | | | | | | | |
| 3-1 | $\alpha$-type titanyl phthalo-cyanine | 1.35 | 4.11 | 3.10 | −105 | −80 | −230 | −150 |

TABLE 3-2

| | Charge-generating material (Exemplary Comp. No.) | Repetition Sensitivity E 1/2 ($\mu$J/cm$^2$) 400 nm | 450 nm | 500 nm | performance (V) $\Delta$Vd | $\Delta$V1 | Photomemory (V) $\Delta Vd_{PM}$ | $\Delta V1_{PM}$ |
|---|---|---|---|---|---|---|---|---|
| Example: | | | | | | | | |
| 3-5 | 4-4 | 0.65 | 0.40 | 0.35 | −15 | 0 | −20 | −10 |
| 3-6 | 4-11 | 1.01 | 0.75 | 0.63 | −30 | −10 | −30 | −20 |
| 3-7 | 4-13 | 0.74 | 0.45 | 0.41 | −30 | −10 | −20 | −15 |
| 3-8 | 4-14 | 0.77 | 0.50 | 0.42 | −40 | −20 | −30 | −20 |
| Comparative Example: | | | | | | | | |
| 3-2 | $\alpha$-type titanyl phthalo-cyanine | 1.30 | 4.06 | 3.07 | −120 | −75 | −230 | −150 |

TABLE 3-3

| | Charge-generating material (Exemplary Comp. No.) | Sensitivity E 1/2 ($\mu J/cm^2$) 400 nm | 450 nm | 500 nm |
|---|---|---|---|---|
| Example: | | | | |
| 3-9 | 4-4 | 0.92 | 0.56 | 0.51 |
| 3-10 | 4-11 | 1.46 | 1.07 | 0.91 |
| 3-11 | 4-13 | 1.07 | 0.65 | 0.59 |
| 3-12 | 4-14 | 1.11 | 0.72 | 0.58 |
| Comparative Example: | | | | |
| 3-3 | α-type titanyl phthalocyanine | 1.62 | 4.93 | 3.68 |

TABLE 3-4

| | Charge-Generating material (Exemplary Comp. No.) | Dot reproducibility | Character reproducibility |
|---|---|---|---|
| Example: | | | |
| 3-13 | 1-4 | sharp | sharp |
| Comparative Example: | | | |
| 3-4 | α-type titanyl phthalocyanine | not reproduced | unsharp (trailed in the direction of secondary scanning) |

TABLE 4-1

| | Charge = generating material (Exemplary Comp. No.) | Repetition Sensitivity E 1/2 ($\mu J/cm^2$) 400 nm | 450 nm | 500 nm | performance (V) ΔVd | ΔV1 | Photomemory (V) $\Delta Vd_{PM}$ | $\Delta V1_{PM}$ |
|---|---|---|---|---|---|---|---|---|
| Example: | | | | | | | | |
| 4-1 | 5-5 | 0.55 | 0.44 | 0.41 | −20 | −15 | −20 | −10 |
| 4-2 | 5-13 | 0.72 | 0.53 | 0.42 | −15 | −5 | −15 | −10 |
| 4-3 | 5-15 | 0.77 | 0.56 | 0.48 | −30 | −10 | −10 | −5 |
| 4-4 | 5-16 | 0.57 | 0.44 | 0.40 | −25 | −15 | −20 | −15 |
| 4-5 | 5-25 | 1.08 | 0.76 | 0.57 | −25 | 0 | −15 | −10 |

TABLE 4-2

| | Charge-generating material (Exemplary Comp. No.) | Sensitivity E 1/2 ($\mu J/cm^2$) 400 nm | 450 nm | 500 nm |
|---|---|---|---|---|
| Example: | | | | |
| 4-6 | 5-5 | 0.64 | 0.52 | 0.50 |
| 4-7 | 5-13 | 0.82 | 0.62 | 0.51 |
| 4-8 | 5-15 | 0.85 | 0.67 | 0.58 |
| 4-9 | 5-16 | 0.66 | 0.53 | 0.51 |
| 4-10 | 5-25 | 1.19 | 0.86 | 0.66 |

TABLE 4-3

| | Charge-Generating material (Exemplary Comp. No.) | Dot reproducibility | Character reproducibility |
|---|---|---|---|
| Example: | | | |
| 4-11 | 5-5 | sharp | sharp |
| 4-12 | 5-13 | sharp | sharp |
| 4-13 | 5-16 | sharp | sharp |

What is claimed is:

1. An electrophotographic photosensitive member comprising a support and a photosensitive layer provided thereon, said photosensitive layer being sensitive to semiconductor laser light having a wavelength of from 380 nm to 500 nm;

said photosensitive layer containing an azo pigment represented by the following Formula (1):

$$Ar\text{-}(N{=}N{-}Cp)_n \quad (1)$$

wherein Ar represents a substituted or unsubstituted aromatic hydrocarbon cyclic group or heterocyclic group which may be bonded directly or via a linking group; Cp represents a coupler residual group represented by the following Formula (2), (3), (4) or (5); and n represents an integer of 1 to 3; provided that a plurality of —N═N—Cp moieties are not bonded to the same benzene ring;

(2)

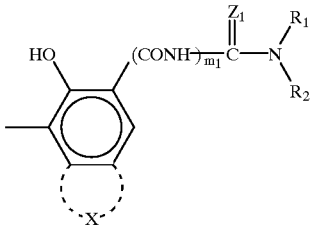

wherein X represents a residual group necessary for condensing with the benzene ring to form a polycyclic aromatic ring or heterocyclic ring; $R_1$ and $R_2$ each represent a hydrogen atom, a substituted or unsubstituted alkyl group, a substituted or unsubstituted aryl group or a substituted or unsubstituted heterocyclic group, and $R_1$ and $R_2$ may form a cyclic amino group via the nitrogen atom in the formula; $Z_1$ represents an oxygen atom or a sulfur atom; and $m_1$ represents an integer of 0 or 1;

(3)

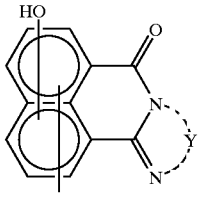

wherein Y represents a substituted or unsubstituted divalent aromatic hydrocarbon cyclic group or a substituted or unsubstituted divalent nitrogen-containing heterocyclic group;

(4)

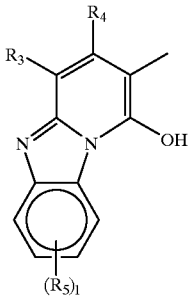

wherein $R_3$ represents a hydrogen atom, a halogen atom, a cyano group, a carboxyl group, an alkoxycarbonyl group, a carbamoyl group or a nitro group; $R_4$ represents a substituted or unsubstituted alkyl group or a substituted or unsubstituted aryl group; $R_5$ represents a halogen atom, a substituted or unsubstituted alkyl group, a substituted or unsubstituted alkoxyl group, a cyano group or a nitro group; and l represents an integer of 0 to 2, and, when l is 2, $R_5$'s may be different groups;

(5)

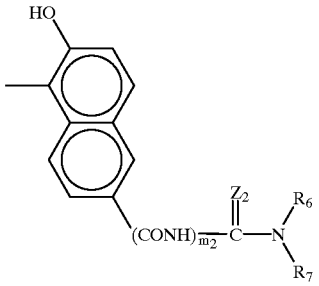

wherein $R_6$ and $R_7$ each represent a hydrogen atom, a substituted or unsubstituted alkyl group, a substituted or unsubstituted aryl group or a substituted or unsubstituted heterocyclic group, and $R_6$ and $R_7$ may form a cyclic amino group via the nitrogen atom in the formula; $Z_2$ represents an oxygen atom or a sulfur atom; and $m_2$ represents an integer of 0 or 1.

2. The electrophotographic photosensitive member according to claim 1, wherein Cp is the coupler residual group represented by Formula (2).

3. The electrophotographic photosensitive member according to claim 1, wherein Cp is the coupler residual group represented by Formula (3).

4. The electrophotographic photosensitive member according to claim 1, wherein Cp is the coupler residual group represented by Formula (4).

5. The electrophotographic photosensitive member according to claim 1, wherein Cp is the coupler residual group represented by Formula (5).

6. The electrophotographic photosensitive member according to claim 1 or 2, wherein said azo pigment is represented by the following formula:

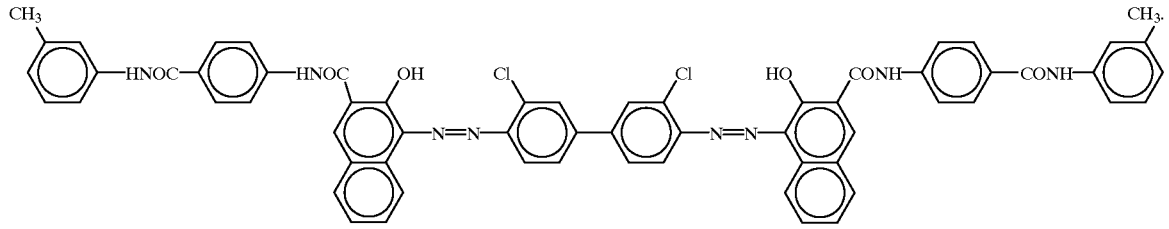

7. The electrophotographic photosensitive member according to claim 1 or 2, wherein said azo pigment is represented by the following formula:

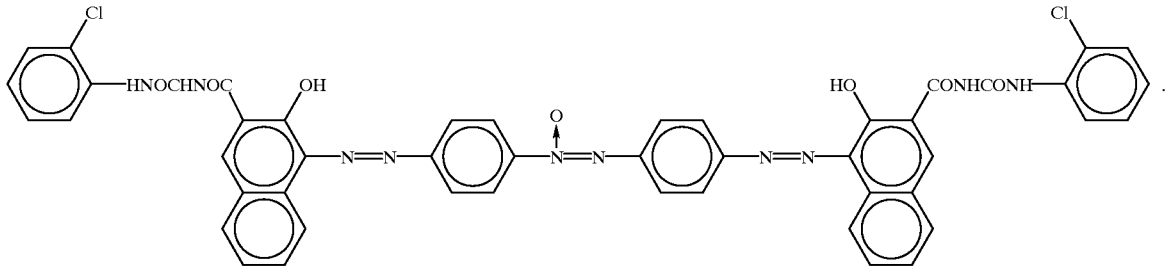

8. The electrophotographic photosensitive member according to claim 1 or 2, wherein said azo pigment is represented by the following formula:

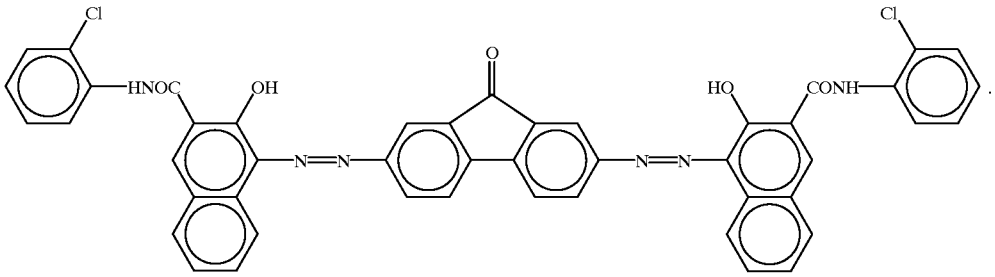

9. The electrophotographic photosensitive member according to claim 1 or 2, wherein said azo pigment is represented by the following formula:

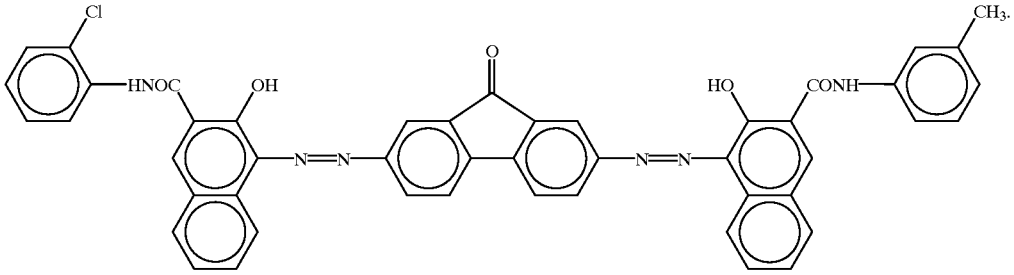

10. The electrophotographic photosensitive member according to claim 1 or 2, wherein said azo pigment is represented by the following formula:

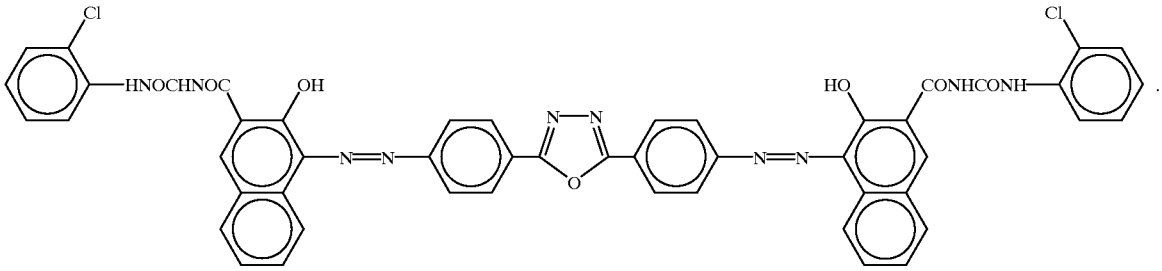

11. The electrophotographic photosensitive member according to claim 1 or 2, wherein said azo pigment is represented by the following formula:

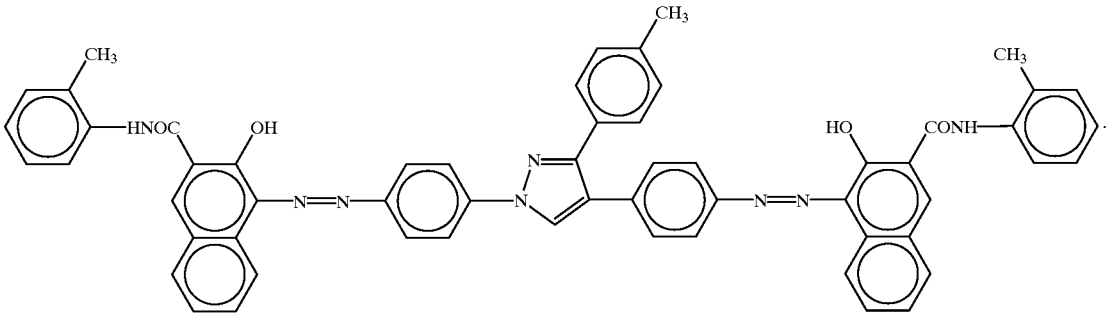

12. The electrophotographic photosensitive member according to claim 1 or 3, wherein said azo pigment is represented by the following formula:

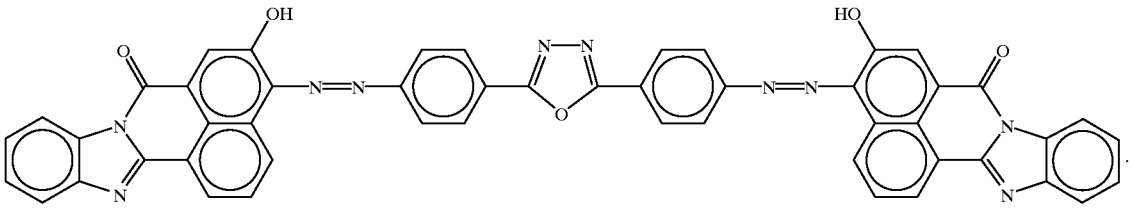

13. The electrophotographic photosensitive member according to claim 1 or 3, wherein said azo pigment is represented by the following formula:

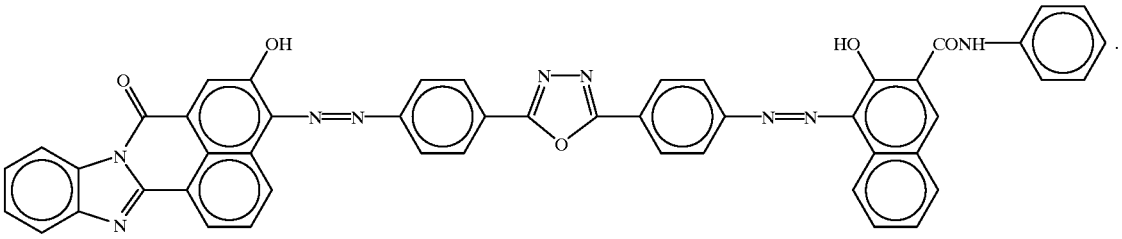

14. The electrophotographic photosensitive member according to claim 1 or 4, wherein said azo pigment is represented by the following formula:

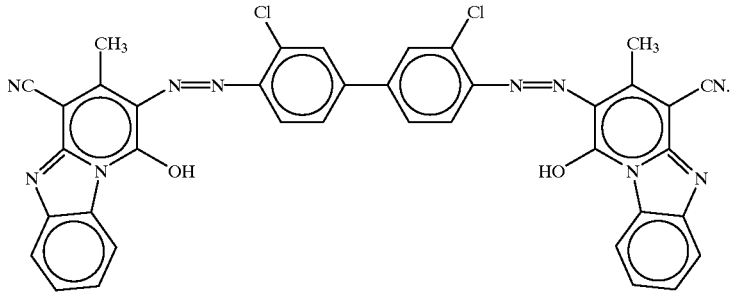

15. The electrophotographic photosensitive member according to claim 1, wherein the wavelength the semiconductor laser light has is from 400 nm to 450 nm.

16. A process cartridge comprising an electrophotographic photosensitive member and a means selected from the group consisting of a charging means, a developing means and a cleaning means;

said electrophotographic photosensitive member and at least one of said means being supported as one unit and being detachably mountable to the main body of an electrophotographic apparatus; and said electrophotographic photosensitive member comprising a support and a photosensitive layer provided thereon, said photosensitive layer being sensitive to semiconductor laser light having a wavelength of from 380 nm to 500 nm;

said photosensitive layer containing an azo pigment represented by the following Formula (1):

$$Ar\text{-}(N{=}N{-}Cp)_n \quad (1)$$

wherein Ar represents a substituted or unsubstituted aromatic hydrocarbon cyclic group or heterocyclic group which may be bonded directly or via a linking group; Cp represents a coupler residual group represented by the following Formula (2), (3), (4) or (5); and n represents an integer of 1 to 3; provided that a plurality of —N═N—Cp moieties are not bonded to the same benzene ring;

(2)

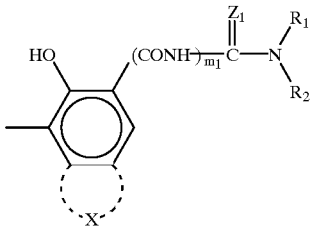

wherein X represents a residual group necessary for condensing with the benzene ring to form a polycyclic aromatic ring or heterocyclic ring; $R_1$ and $R_2$ each represent a hydrogen atom, a substituted or unsubstituted alkyl group, a substituted or unsubstituted aryl group or a substituted or unsubstituted heterocyclic group, and $R_1$ and $R_2$ may form a cyclic amino group via the nitrogen atom in the formula; $Z_1$ represents an oxygen atom or a sulfur atom; and $m_1$ represents an integer of 0 or 1;

(3)

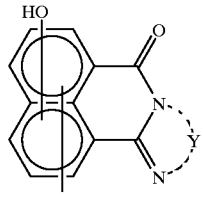

wherein Y represents a substituted or unsubstituted divalent aromatic hydrocarbon cyclic group or a substituted or unsubstituted divalent nitrogen-containing heterocyclic group;

(4)

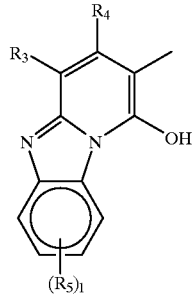

wherein $R_3$ represents a hydrogen atom, a halogen atom, a cyano group, a carboxyl group, an alkoxycarbonyl group, a carbamoyl group or a nitro group; $R_4$ represents a substituted or unsubstituted alkyl group or a substituted or unsubstituted aryl group; $R_5$ represents a halogen atom, a substituted or unsubstituted alkyl group, a substituted or unsubstituted alkoxyl group, a cyano group or a nitro group; and l represents an integer of 0 to 2, and, when l is 2, $R_5$'s may be different groups;

(5)

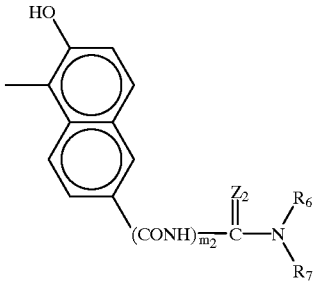

wherein $R_6$ and $R_7$ each represent a hydrogen atom, a substituted or unsubstituted alkyl group, a substituted or unsubstituted aryl group or a substituted or unsubstituted heterocyclic group, and $R_6$ and $R_7$ may form a cyclic amino group via the nitrogen atom in the formula; $Z_2$ represents an oxygen atom or a sulfur atom; and $m_2$ represents an integer of 0 or 1.

17. The process cartridge according to claim 16, wherein Cp is the coupler residual group represented by Formula (2).

18. The process cartridge according to claim 16, wherein Cp is the coupler residual group represented by Formula (3).

19. The process cartridge according to claim 16, wherein Cp is the coupler residual group represented by Formula (4).

20. The process cartridge according to claim 16, wherein Cp is the coupler residual group represented by Formula (5).

21. The process cartridge according to claim 16 or 17, wherein said azo pigment is represented by the following formula:

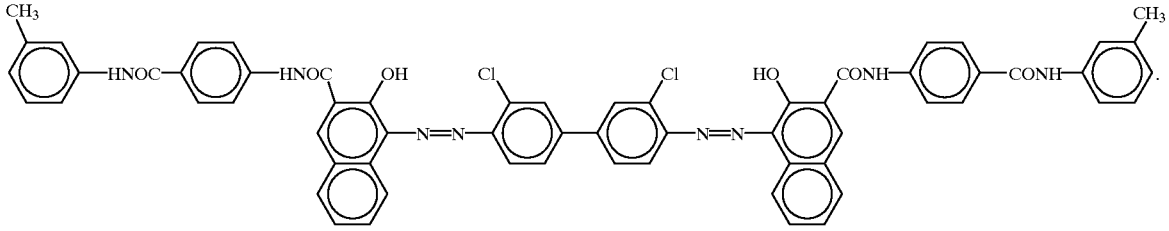

22. The process cartridge according to claim 16 or 17, wherein said azo pigment is represented by the following formula:

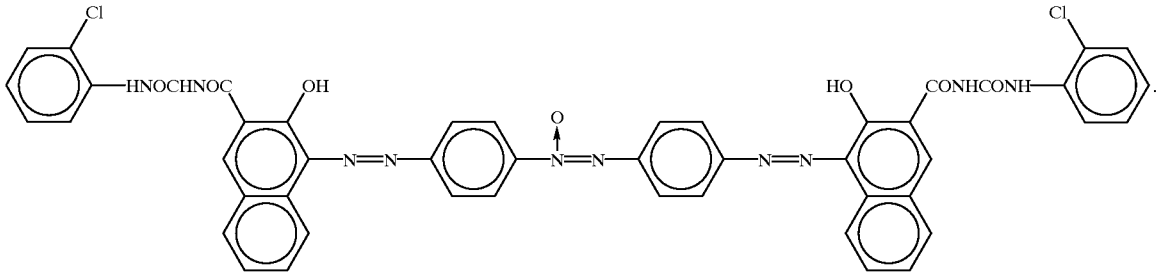

23. The process cartridge according to claim 16 or 17, wherein said azo pigment is represented by the following formula:

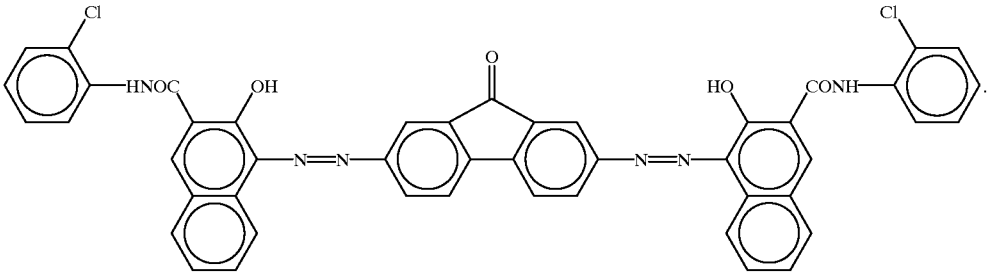

24. The process cartridge according to claim 16 or 17, wherein said azo pigment is represented by the following formula:

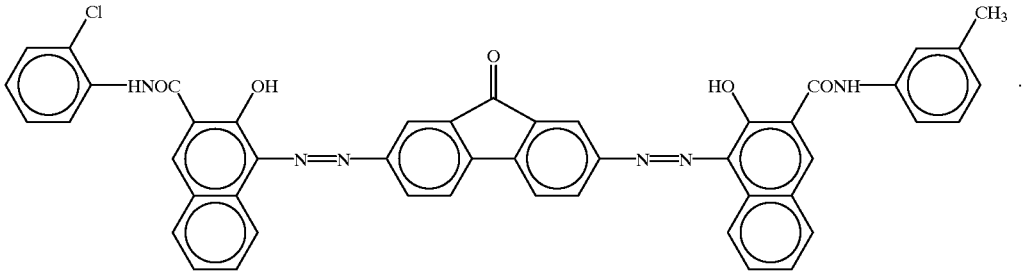

25. The process cartridge according to claim 16 or 17, wherein said azo pigment is represented by the following formula:

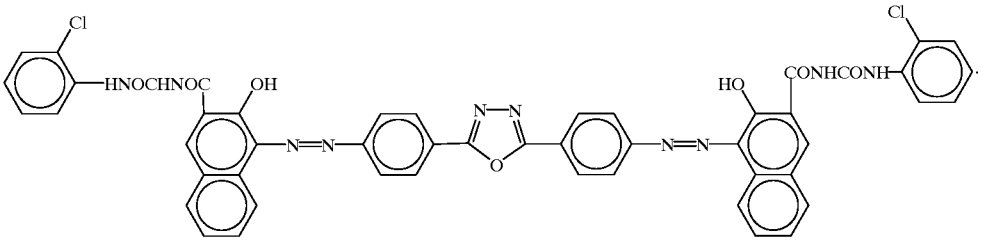

26. The process cartridge according to claim 16 or 17, wherein said azo pigment is represented by the following formula:

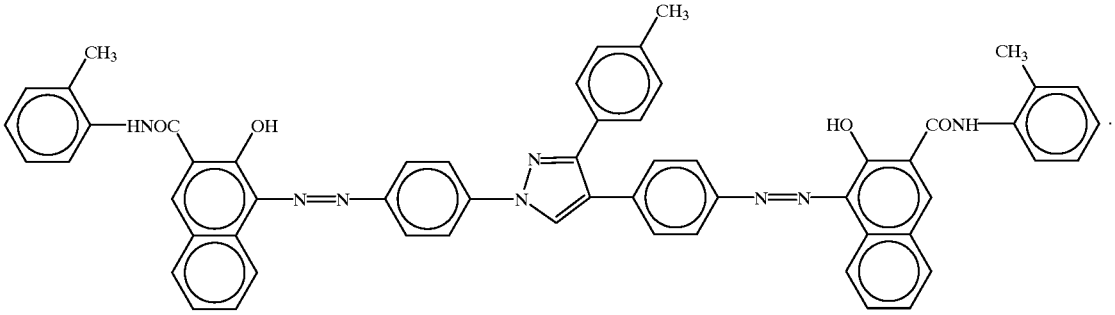

27. The process cartridge according to claim 16 or 18, wherein said azo pigment is represented by the following formula:

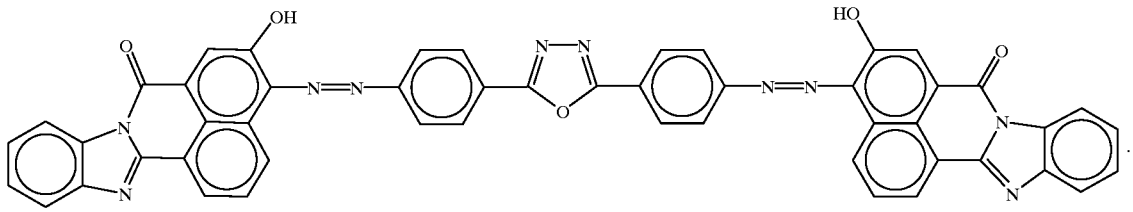

28. The process cartridge according to claim 16 or 18, wherein said azo pigment is represented by the following formula:

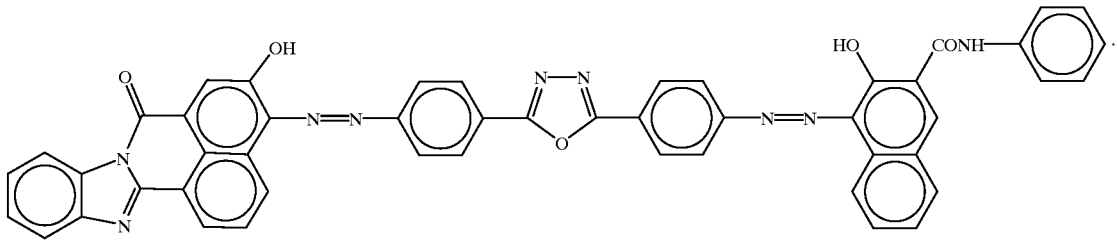

29. The process cartridge according to claim 16 or 19, wherein said azo pigment is represented by the following formula:

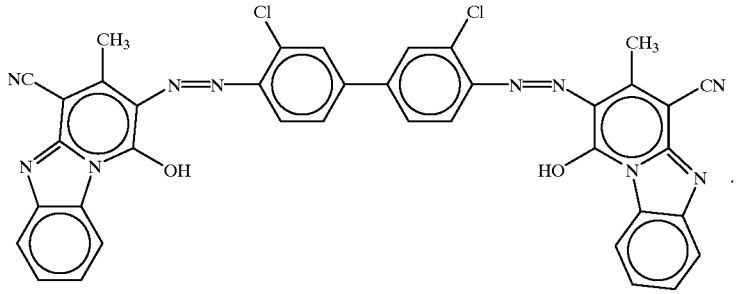

30. The process cartridge according to claim 16, wherein the wavelength the semiconductor laser light has is from 400 nm to 450 nm.

31. An electrophotographic apparatus comprising an electrophotographic photosensitive member, a charging means, an exposure means, a developing means and a transfer means;

said exposure means having a semiconductor laser having an oscillation wavelength of from 380 nm to 500 nm as an exposure light source; and said electrophotographic photosensitive member comprising a support and a photosensitive layer provided thereon;

said photosensitive layer containing an azo pigment represented by the following Formula (1);

$$Ar\text{-}(N{=}N{-}Cp)_n \qquad (1)$$

wherein Ar represents a substituted or unsubstituted aromatic hydrocarbon cyclic group or heterocyclic group which may be bonded directly or via a linking group; Cp represents a coupler residual group represented by the following Formula (2), (3), (4) or (5); and n represents an integer of 1 to 3; provided that a plurality of —N=N—Cp moieties are not bonded to the same benzene ring;

(2)

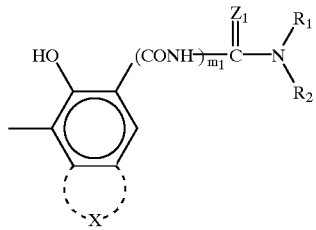

wherein X represents a residual group necessary to condense with the benzene ring to form a polycyclic aromatic ring or heterocyclic ring; $R_1$ and $R_2$ each represent a hydrogen atom, a substituted or unsubstituted alkyl group, a substituted or unsubstituted aryl group or a substituted or unsubstituted heterocyclic group, and $R_1$ and $R_2$ may form a cyclic amino group via the nitrogen atom in the formula; $Z_1$ represents an oxygen atom or a sulfur atom; and $m_1$ represents an integer of 0 or 1;

(3)

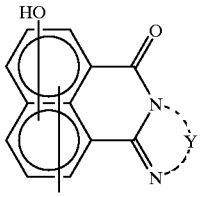

wherein Y represents a substituted or unsubstituted divalent aromatic hydrocarbon cyclic group or a substituted or unsubstituted divalent nitrogen-containing heterocyclic group;

(4)

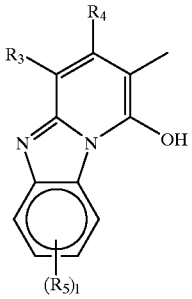

wherein $R_3$ represents a hydrogen atom, a halogen atom, a cyano group, a carboxyl group, an alkoxycarbonyl group, a carbamoyl group or a nitro group; $R_4$ represents a substituted or unsubstituted alkyl group or a substituted or unsubstituted aryl group; $R_5$ represents a halogen atom, a substituted or unsubstituted alkyl group, a substituted or unsubstituted alkoxyl group, a cyano group or a nitro group; and l represents an integer of 0 to 2, and, when l is 2, $R_5$'s may be different groups;

(5)

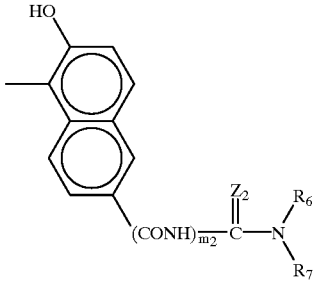

wherein $R_6$ and $R_7$ each represent a hydrogen atom, a substituted or unsubstituted alkyl group, a substituted or unsubstituted aryl group or a substituted or unsubstituted heterocyclic group, and $R_6$ and $R_7$ may form a cyclic amino group via the nitrogen atom in the formula; $Z_2$ represents an oxygen atom or a sulfur atom; and $m_2$ represents an integer of 0 or 1.

32. The electrophotographic apparatus according to claim 31, wherein Cp is the coupler residual group represented by Formula (2).

33. The electrophotographic apparatus according to claim 31, wherein Cp is the coupler residual group represented by Formula (3).

34. The electrophotographic apparatus according to claim 31, wherein Cp is the coupler residual group represented by Formula (4).

35. The electrophotographic apparatus according to claim 31, wherein Cp is the coupler residual group represented by Formula (5).

36. The electrophotographic apparatus according to claim 31 or 32, wherein said azo pigment is represented by the following formula:

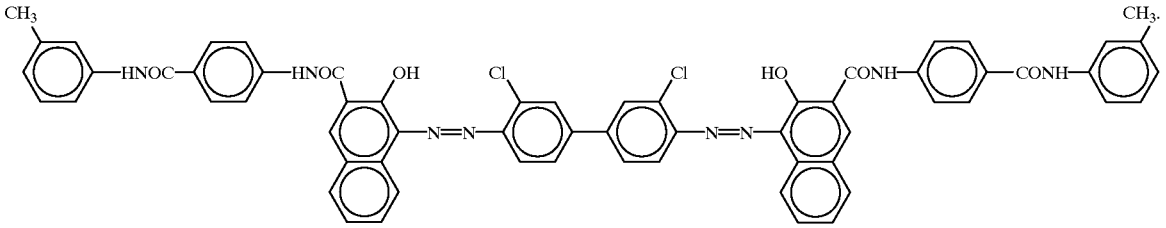

37. The electrophotographic apparatus according to claim 31 or 32, wherein said azo pigment is represented by the following formula:

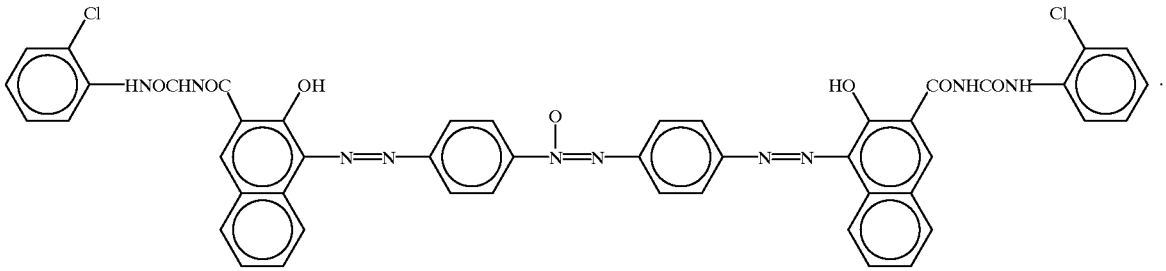

38. The electrophotographic apparatus according to claim 31 or 32, wherein said azo pigment is represented by the following formula:

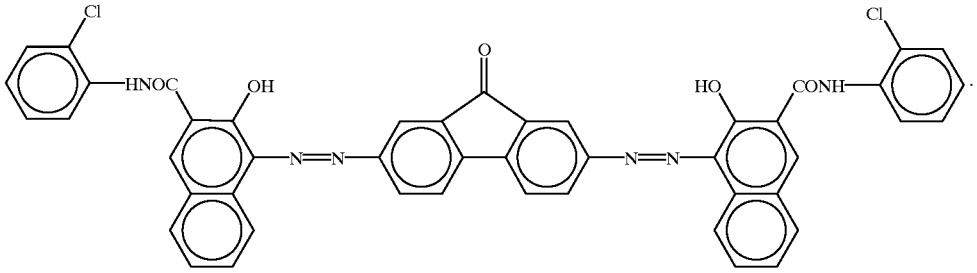

39. The electrophotographic apparatus according to claim 31 or 32, wherein said azo pigment is represented by the following formula:

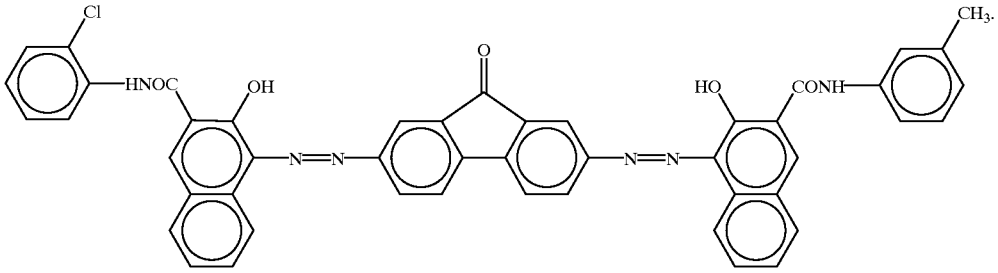

40. The electrophotographic apparatus according to claim 31 or 32, wherein said azo pigment is represented by the following formula:

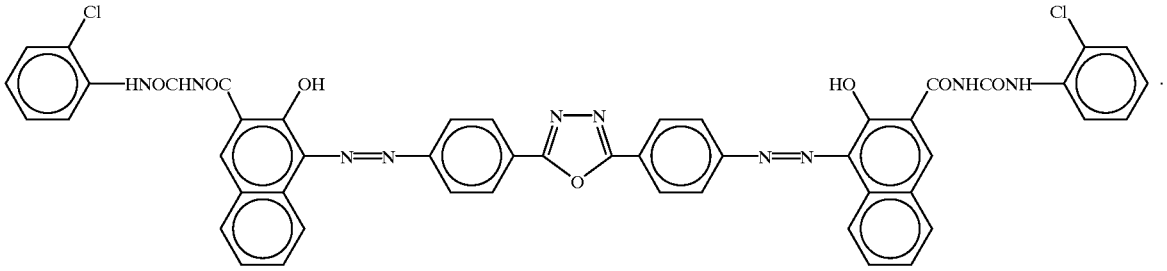

41. The electrophotographic apparatus according to claim 31 or 32, wherein said azo pigment is represented by the following formula:

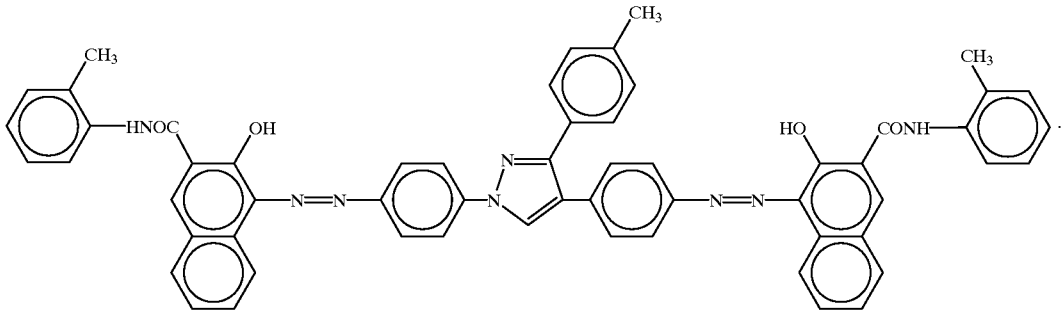

42. The electrophotographic apparatus according to claim 31 or 33, wherein said azo pigment is represented by the following formula:

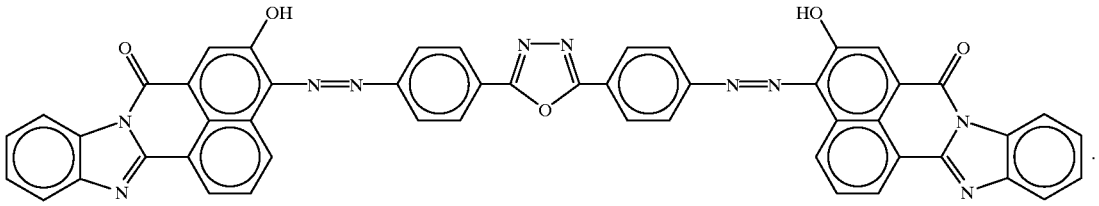

43. The electrophotographic apparatus according to claim 31 or 33, wherein said azo pigment is represented by the following formula:

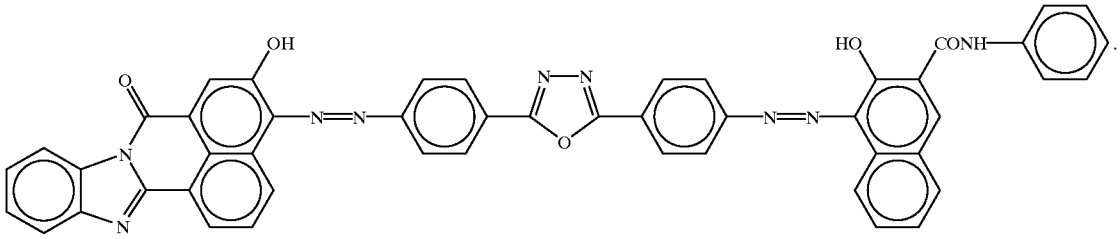

44. The electrophotographic apparatus according to claim 31 or 34, wherein said azo pigment is represented by the following formula:

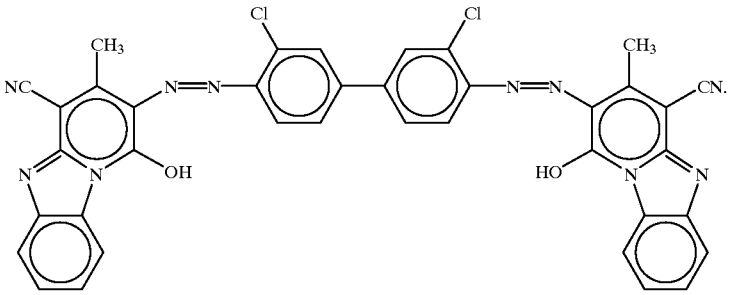

45. The electrophotographic apparatus according to claim 31, wherein said semiconductor laser has a wavelength of from 400 nm to 450 nm.

* * * * *

UNITED STATES PATENT AND TRADEMARK OFFICE

CERTIFICATE OF CORRECTION

PATENT NO. : 6,183,922 B1
DATED : February 6, 2001
INVENTOR(S) : Hideyuki Takai et al.

It is certified that error appears in the above-identified patent and that said Letters Patent is hereby corrected as shown below:

Title page,
Item [56], References Cited, OTHER PUBLICATIONS,
"and" should read -- of --.

Column 6,
Line 4, "group s" should read -- groups --;
Line 30, "perinapthylene," should read -- para-napthylene, --;
Line 48, "group" should read -- groups --.

Column 19,
Line 54, "*Ecemplary" should read -- *Exemplary --.

Column 39,
Ex. 4-17, "—C(=O)—" should read —C(=O)—.

Column 41,
Line 51, Japanese characters should read should read -- *Ar --.

Column 64,
Line 25, "polycaronates" should read -- polycarbonates --.

Column 69,
Line 45, "a show" should read -- show a --.

Column 72,
Table 1-1, "Repetition
Sensitivity E 1/2 (μmJ/cm$^2$) performance (V)"

should read

-- Repetition
Sensitivity E 1/2 (μmJ/cm$^2$) performance (V)"

Table 1-2, "Repetition
Sensitivity E 1/2 (μmJ/cm$^2$) performance (V)"

should read

-- Repetition
Sensitivity E 1/2 (μmJ/cm$^2$) performance (V)"

UNITED STATES PATENT AND TRADEMARK OFFICE

CERTIFICATE OF CORRECTION

PATENT NO. : 6,183,922 B1
DATED : February 6, 2001
INVENTOR(S) : Hideyuki Takai et al.

It is certified that error appears in the above-identified patent and that said Letters Patent is hereby corrected as shown below:

Column 74,
Table 2-1, "Repetition
Sensitivity E 1/2 (μmJ/cm$^2$) performance (V)"

should read

-- Repetition
Sensitivity E 1/2 (μmJ/cm$^2$) performance (V)"

Table 2-2, "Repetition
Sensitivity E 1/2 (μmJ/cm$^2$) performance (V)"

should read

-- Repetition
Sensitivity E 1/2 (μmJ/cm$^2$) performance (V)"

Column 76,
Table 3-1, "Repetition
Sensitivity E 1/2 (μmJ/cm$^2$) performance (V)"

should read

-- Repetition
Sensitivity E 1/2 (μmJ/cm$^2$) performance (V)"

Table 3-2, "Repetition
Sensitivity E 1/2 (μmJ/cm$^2$) performance (V)"

should read

-- Repetition
Sensitivity E 1/2 (μmJ/cm$^2$) performance (V)"

Column 77,
Table 4-1, "Repetition
Sensitivity E 1/2 (μmJ/cm$^2$) performance (V)"

should read

-- Repetition
Sensitivity E 1/2 (μmJ/cm$^2$) performance (V)"

UNITED STATES PATENT AND TRADEMARK OFFICE

CERTIFICATE OF CORRECTION

PATENT NO. : 6,183,922 B1
DATED : February 6, 2001
INVENTOR(S) : Hideyuki Takai et al.

It is certified that error appears in the above-identified patent and that said Letters Patent is hereby corrected as shown below:

Column 94,
Lines 59-61, "—N(=O)=N—" should read – —N(→O)=N— --.

Signed and Sealed this

Nineteenth Day of February, 2002

*Attest:*

*Attesting Officer*

JAMES E. ROGAN
*Director of the United States Patent and Trademark Office*